US011905762B2

(12) United States Patent
Meier et al.

(10) Patent No.: US 11,905,762 B2
(45) **Date of Patent: *Feb. 20, 2024**

(54) TRANSMISSION LINE TENSION ANCHOR FOR DRILL STRING COMPONENTS

(71) Applicant: INTELLISERV, LLC, Houston, TX (US)

(72) Inventors: David C. Meier, American Fork, UT (US); Jacob Yardley, West Jordan, UT (US)

(73) Assignee: INTELLISERV, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/160,437

(22) Filed: Jan. 27, 2023

(65) Prior Publication Data

US 2023/0175323 A1 Jun. 8, 2023

Related U.S. Application Data

(63) Continuation of application No. 17/198,361, filed on Mar. 11, 2021, now Pat. No. 11,585,160.

(51) Int. Cl.
*E21B 17/02* (2006.01)

(52) U.S. Cl.
CPC ..... *E21B 17/023* (2013.01); *E21B 17/028* (2013.01)

(58) Field of Classification Search
CPC .... E21B 17/003; E21B 17/023; E21B 17/028; E21B 17/0285
See application file for complete search history.

(56) References Cited

U.S. PATENT DOCUMENTS

| | | | |
|---|---|---|---|
| 6,981,546 | B2 | 1/2006 | Hall et al. |
| 7,291,303 | B2 | 11/2007 | Hall et al. |
| 8,118,093 | B2 | 2/2012 | Hassell et al. |

(Continued)

FOREIGN PATENT DOCUMENTS

| | | | |
|---|---|---|---|
| CA | 2922791 | A1 | 3/2015 |
| WO | 2014194018 | A1 | 12/2014 |
| WO | 2015020893 | A1 | 2/2015 |

OTHER PUBLICATIONS

International Search Report and Written Opinion issued in Application No. PCT/US2022/019755, dated Jun. 2, 2022.

(Continued)

*Primary Examiner* — David Carroll
(74) *Attorney, Agent, or Firm* — JONES ROBB, PLLC

(57) ABSTRACT

An apparatus for retaining a transmission line within a drill string component includes a drill string component comprising a bore having an internal diameter. A slot having a shoulder is formed in the internal surface to receive an electromagnetic transmission line. A tension anchor is configured to be attached to the electromagnetic transmission line. The tension anchor comprises an inner sleeve configured to be crimped onto an outer diameter of the electromagnetic transmission line, and an outer sleeve configured to be coupled with the inner sleeve. The outer sleeve comprises an electrical connector device configured to be electrically coupled with the electromagnetic transmission line. The tension anchor is further configured to be received in the slot in engagement with the shoulder.

18 Claims, 24 Drawing Sheets

(56) References Cited

U.S. PATENT DOCUMENTS

| | | | | |
|---|---|---|---|---|
| 9,722,400 | B2 | 8/2017 | Koppe et al. | |
| 2004/0244964 | A1 | 12/2004 | Hall et al. | |
| 2005/0087368 | A1* | 4/2005 | Boyle | E21B 17/028 175/57 |
| 2007/0169929 | A1 | 7/2007 | Hall et al. | |
| 2008/0110638 | A1 | 5/2008 | Hall et al. | |
| 2010/0111592 | A1 | 5/2010 | Hassell et al. | |
| 2012/0111555 | A1 | 5/2012 | Leveau et al. | |
| 2013/0180729 | A1* | 7/2013 | Wright | E21B 17/003 166/57 |
| 2014/0102806 | A1* | 4/2014 | Millet | E21B 47/12 175/315 |
| 2014/0209296 | A1 | 7/2014 | Rahn et al. | |
| 2014/0284065 | A1* | 9/2014 | Fraignac | E21B 17/042 166/242.6 |
| 2015/0000957 | A1 | 1/2015 | Koppe et al. | |
| 2015/0041214 | A1 | 2/2015 | Mueller et al. | |
| 2015/0070185 | A1* | 3/2015 | Schulz | E21B 47/13 340/854.4 |
| 2021/0062589 | A1* | 3/2021 | Kennedy | E21B 17/023 |

OTHER PUBLICATIONS

International Search Report and Written Opinion issued in Application No. PCT/US2022/019758, dated Jun. 14, 2022.

International Search Report and Written Opinion issued in Application No. PCT/US2022/019760, dated Jun. 14, 2022.

* cited by examiner

TRANSMISSION LINE TENSION ANCHOR FOR DRILL STRING COMPONENTS

CROSS REFERENCE TO RELATED APPLICATIONS

This application is a continuation application of U.S. patent application Ser. No. 17/198,361, filed Mar. 11, 2021, currently pending, the entire contents of which is incorporated by reference herein. This application is also related to International Patent Application No. PCT/US2022/019760, filed Mar. 10, 2022, the entire contents of which is incorporated by reference herein.

BACKGROUND

Field of the Invention

This invention relates to apparatus and methods for transmitting data and signals along a drill string.

Background of the Invention

For at least a half century, the oil and gas industry has sought to develop downhole telemetry systems that enable high-definition formation evaluation and borehole navigation while drilling in real time. The ability to transmit large amounts of sub-surface data to the surface has the potential to significantly decrease drilling costs by enabling operators to more accurately direct the drill string to hydrocarbon deposits. Such information may also improve safety and reduce the environmental impacts of drilling. This technology may also be desirable to take advantage of numerous advances in the design of tools and techniques for oil and gas exploration, and may be used to provide real-time access to data such as temperature, pressure, inclination, salinity, and the like, while drilling.

In order to transmit data at high speeds along a drill string, various approaches have been attempted or suggested. One approach that is currently being implemented and achieving commercial success is to incorporate data transmission lines, or wires, into drill string components to bi-directionally transmit data along the drill string. For example, drill string components may be modified to include high-speed, high-strength data cable running through the central bores of these components. In certain cases, this approach may require placing repeaters or amplifiers at selected intervals along the drill string to amplify or boost the signal as it travels along the transmission lines.

In order to implement a "wired" drill string, apparatus and methods are needed to route transmission lines or wires, such as coaxial cable, along or through the central bore of drill string components. Ideally, such apparatus and methods would be able to hold the transmission lines under tension to minimize movement of the transmission line within the central bore as well as minimize interference with tools or debris moving therethrough. Further needed are apparatus and method to seal and isolate the transmission line from drilling fluids traveling through the central bore of the drill string. Yet further needed are apparatus and methods to quickly install the transmission lines in drill string components, while minimizing the need for expensive equipment or highly trained personnel.

SUMMARY

The invention has been developed in response to the present state of the art and, in particular, in response to the problems and needs in the art that have not yet been fully solved by currently available apparatus and methods. Accordingly, embodiments of the invention have been developed to more effectively retain transmission lines within drill string components. The features and advantages of the invention will become more fully apparent from the following description and appended claims, or may be learned by practice of the invention as set forth hereinafter.

Consistent with the foregoing, an apparatus for retaining a transmission line within a drill string component is disclosed. In one embodiment, such an apparatus includes a drill string component comprising a bore having an internal diameter. A slot is formed in the internal diameter to receive a transmission line. A first feature within the slot is configured to engage a corresponding second feature on the transmission line and thereby retain an end of the transmission line. A sleeve is inserted into the internal diameter to keep the transmission line within the slot.

In another aspect of the invention, a system for retaining a transmission line within a drill string component is disclosed. In one embodiment, such a system includes a drill string that comprises a drill string component. The drill string component has a bore having an internal diameter. A slot is formed in the internal diameter to receive a transmission line. A first feature within the slot is configured to engage a corresponding second feature on the transmission line and thereby retain an end of the transmission line. A sleeve is inserted into the internal diameter to keep the transmission line within the slot.

In another aspect of the invention, an apparatus for retaining a transmission line within a drill string component includes a drill string component comprising a bore having an internal diameter. A slot is formed in the internal diameter to receive a transmission line. A first feature within the slot is configured to engage a corresponding second feature on the transmission line and thereby retain an end of the transmission line. The first feature comprises a first angled surface configured to contact and engage a corresponding second angled surface of the second feature. The first and second angled surfaces are oriented such to keep the transmission line retained within the slot when tension is placed on the transmission line.

In another aspect of the invention, a system for retaining a transmission line within a drill string component includes a drill string comprising a drill string component. The drill string component has a bore having an internal diameter. A slot is formed in the internal diameter to receive a transmission line. A first feature within the slot is configured to engage a corresponding second feature on the transmission line and thereby retain an end of the transmission line. The first feature comprises a first angled surface configured to contact and engage a corresponding second angled surface of the second feature. The first and second angled surfaces are oriented such to keep the transmission line retained within the slot when tension is placed on the transmission line.

In another aspect of the invention, an apparatus for retaining a transmission line within a drill string component includes a drill string component comprising a bore having an internal diameter. A slot is formed in the internal diameter to receive a transmission line. A shoulder within the slot is configured to engage a tension anchor attached to the transmission line. The tension anchor is configured to hold tension in the transmission line. The tension anchor includes a first component that is attached to the transmission line, and a second component that is threaded onto the first component. In certain embodiments, the second component contains a connector configured to enable connection to the transmission line.

In another aspect of the invention, a system for retaining a transmission line within a drill string component includes a drill string comprising a drill string component. The drill string component has a bore having an internal diameter. A slot is formed in the internal diameter to receive a transmission line. A shoulder within the slot is configured to engage a tension anchor attached to the transmission line. The tension anchor is configured to hold tension in the transmission line. The tension anchor includes a first component that is attached to the transmission line, and a second component that is threaded onto the first component. In certain embodiments, the second component contains a connector configured to enable connection to the transmission line.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may be easily made without departing from the essential characteristics of the invention, as described in connection with the Figures. Thus, the following description of the Figures is intended only by way of example, and simply illustrates certain selected embodiments consistent with the invention as claimed herein.

Figure 1:
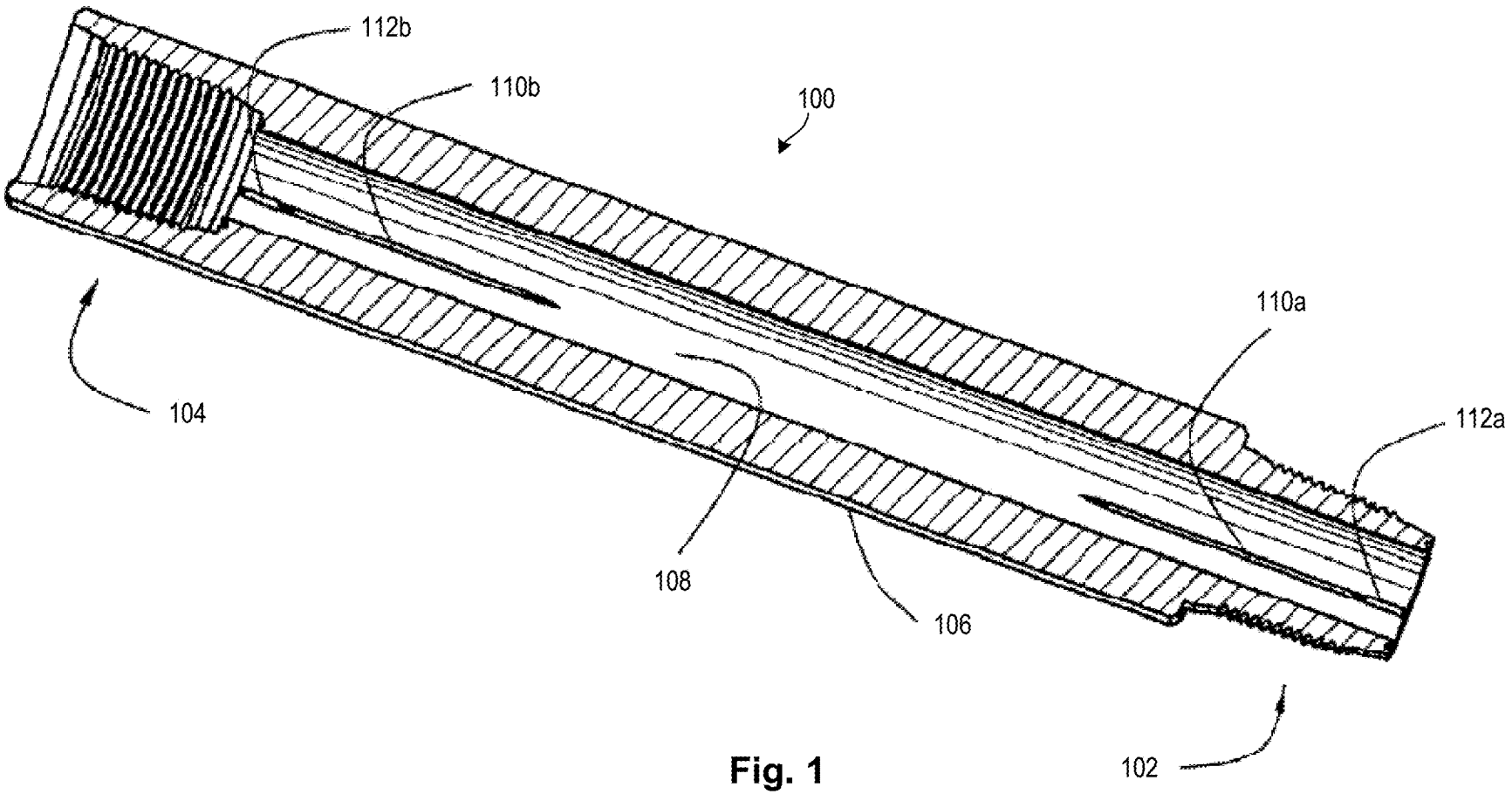
FIG. 1 is a cross-sectional view showing a drill string component with a slot in each end configured to retain a transmission line.

Referring to FIG. 1, a cross-sectional view showing one embodiment of a drill string component 100 is illustrated. As shown, the drill string component 100 includes a pin end 102 and box end 104. Between the pin end 102 and box end 104 is the body 106 of the drill string component 100. A typical length for a drill string component 100 is between twenty and ninety feet. Multiple drill string components 100 may be assembled into a drill string that can extend as long as 30,000 feet, which means that many hundreds of drill string components 100 (e.g., sections of drill pipe and downhole tools) may be assembled into a drill string. A drill string component 100 may include any number of downhole tools, including but not limited to heavyweight drill pipe, drill collar, crossovers, mud motors, directional drilling equipment, stabilizers, hole openers, sub-assemblies, under-reamers, drilling jars, drilling shock absorbers, and other specialized devices, which are all well known in the drilling industry.

Various different designs may be used for the pin end 102 and box end 104 of the drill string component 100. Embodiments of the invention are useful for pin and box end designs that have a uniform or upset internal diameter 108 with the rest of the drill string component 100. As shown, slots 110*a*, 110*b* may be incorporated into the pin end 102 and box end 104 of the drill string component 100 to receive a transmission line. The transmission line may communicate signals between the pin end 102 and box end 104 of the drill string component 100, thereby enabling data to be transmitted along the drill string. In certain embodiments, the slots 110*a*, 110*b* may be open to the internal diameter 108 of the drill string component 100 to facilitate installation of the transmission line. As further shown, features 112*a*, 112*b* (e.g., shoulders, etc.) may be incorporated into the slots 110*a*, 110*b* to aid in retaining ends of the transmission line. These features 112*a*, 112*b* may be implemented in various different ways as will be discussed in more detail hereafter.

Figure 2:
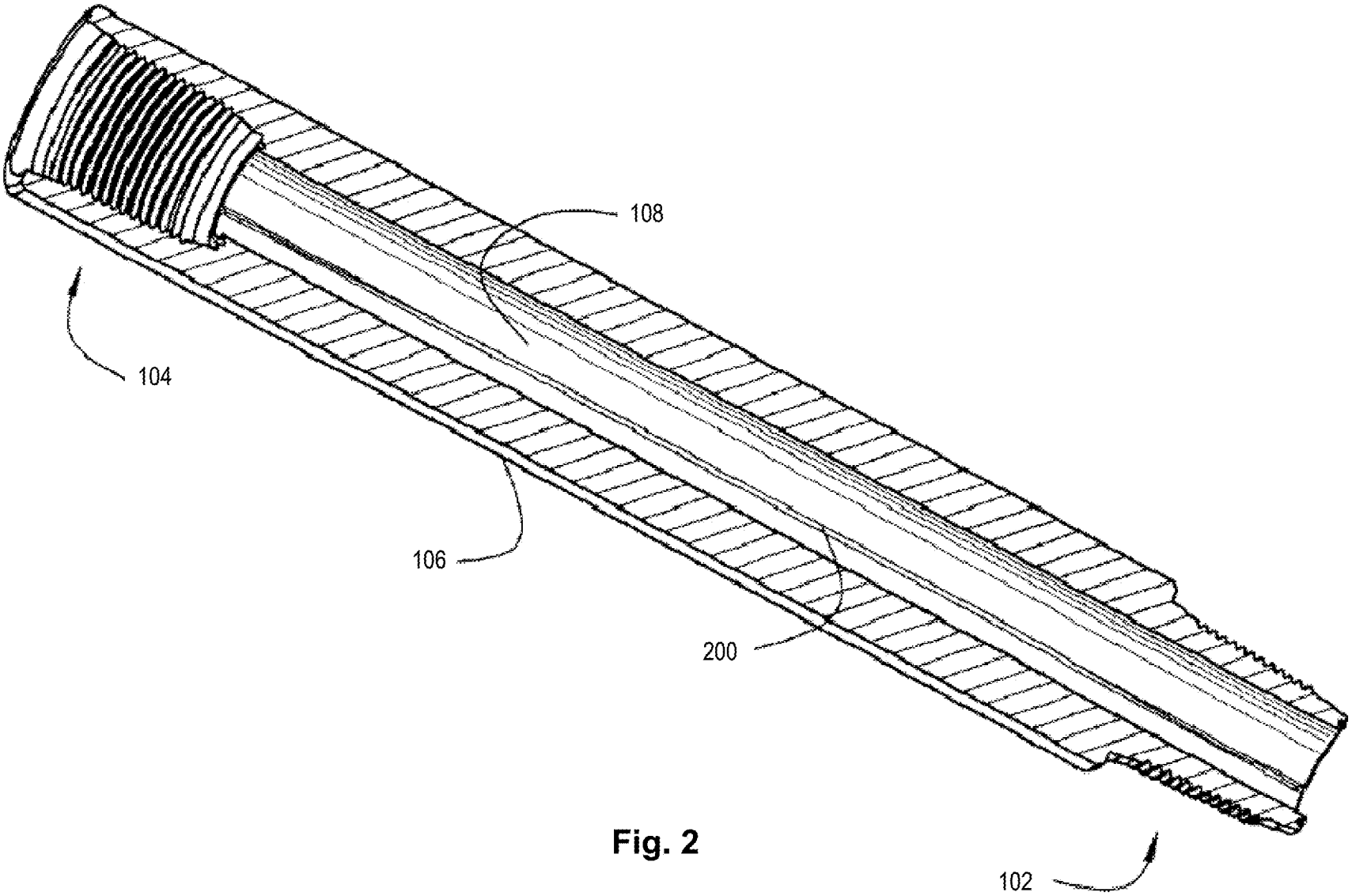
FIG. 2 is a cross-sectional view showing the drill string component of FIG. 1 with the transmission line installed.

FIG. 2 shows the drill string component 100 of FIG. 1 with the transmission line 200 installed. As shown, the transmission line 200 is routed through the internal diameter 108 along the length of the drill string component 100. One end of the transmission line 200 is retained at or near the pin end 102 and the other end of the transmission line 200 is retained at or near the box end 104. In certain embodiments, the transmission line 200 is an armored transmission line 200, meaning that metal tubing or another robust material may surround the transmission line 200 and be used to protect internal wiring and/or insulation of the transmission line 200. Inside the armor, the transmission line 106 may include coaxial cable, electrical wires, optical fibers, or other conductors or cables capable of transmitting a signal.

One potential problem with routing a transmission line 200 through a drill string component 100 is that the transmission line 200 may interfere with tools, fluids, or debris moving through the central bore 108 of the drill string component 100. These tools, fluids, or debris have the potential to sever or damage the transmission line 200, thereby terminating or interrupting signals transmitted along the drill string. Thus, apparatus and methods are needed to route transmission lines 200 through drill string components 100 in a safe and reliable manner. Ideally, such apparatus and methods would be able to maintain tension in the transmission line 200 to minimize movement within the central bore 108 and minimize interference with tools or other debris moving therethrough. Ideally, such apparatus and methods will enable quick and inexpensive installation of transmission lines 106 in drill string components 100 without the need for expensive equipment or highly trained personnel.

Figure 3:
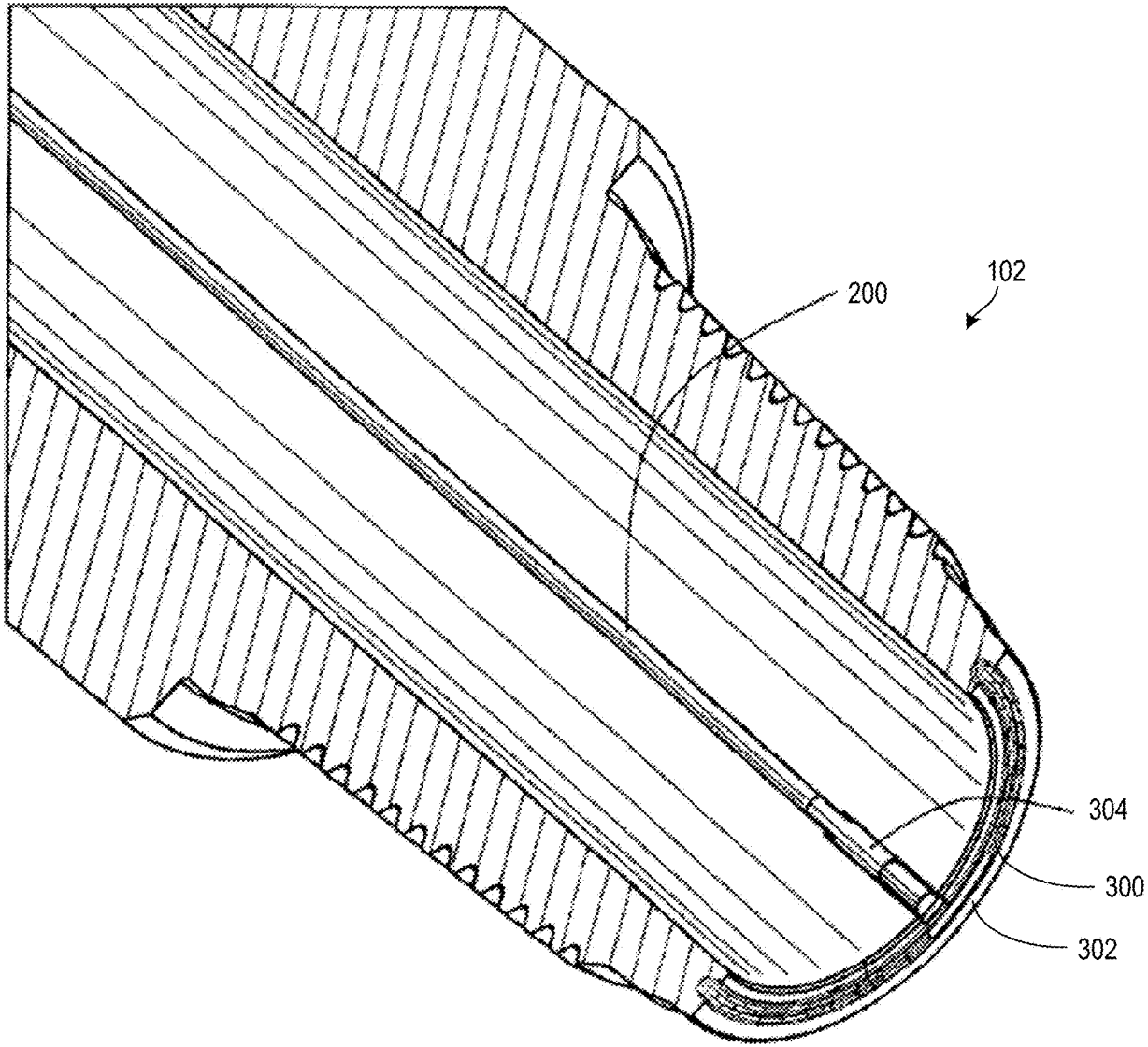
FIG. 3 is an enlarged cross-sectional view showing the pin end of the drill string component.

FIG. 3 is an enlarged cross-sectional view showing a pin end 102 of a drill string component 100. As shown, the pin end 102 may include a transmission element 300 installed in a groove or recess in a leading face 302 of the pin end 102 to transmit data and signals across the tool joint. A corresponding transmission element 300 may be installed in the box end 104. The transmission element 300 may communicate using any known method. For example, in certain embodiments, the transmission element 300 may use direct electrical contacts or inductive coupling to transmit data signals across the tool joint.

Figure 4:
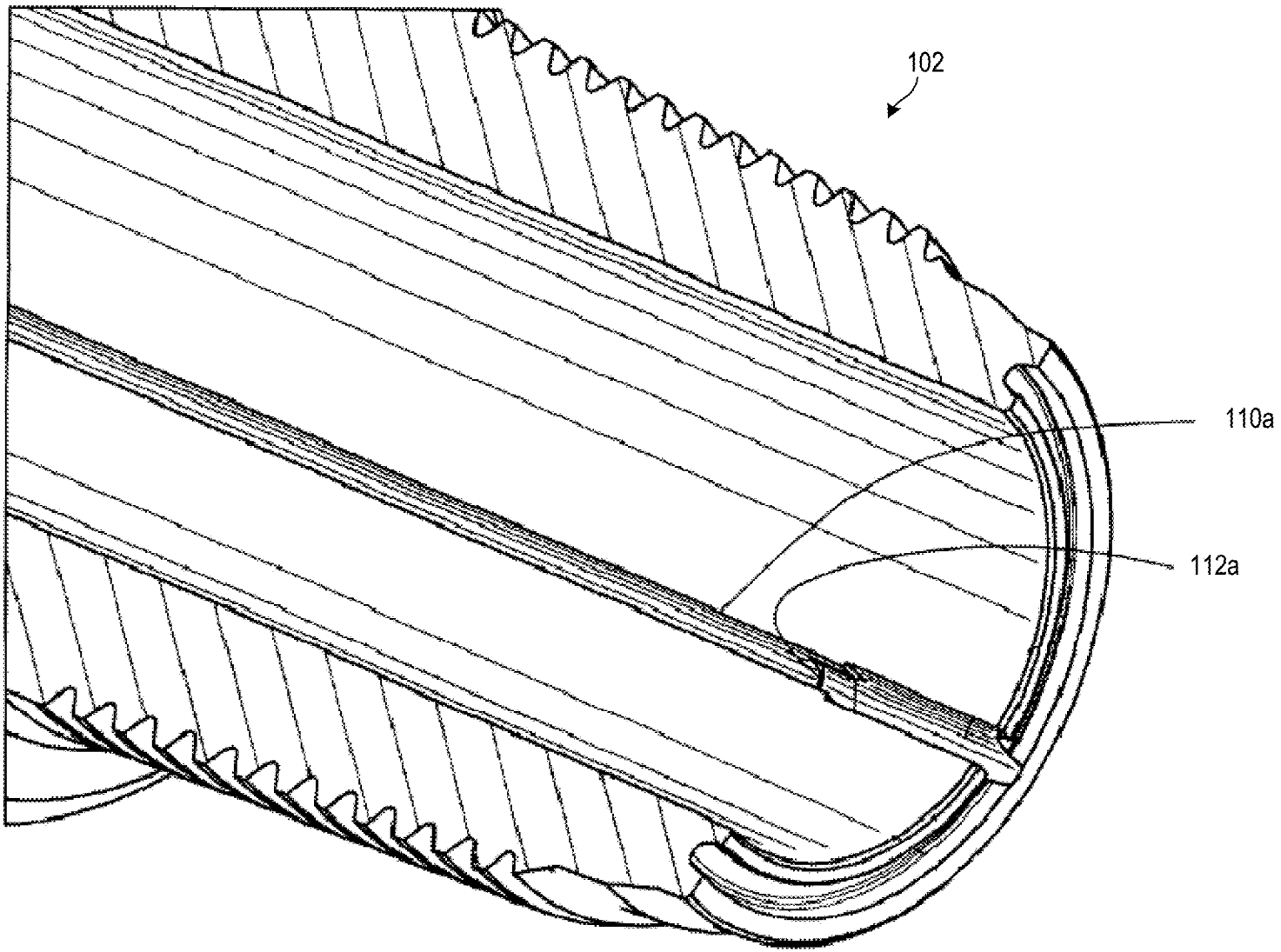
FIG. 4 is an enlarged cross-sectional view showing the pin end and associated slot of the drill string component.

FIG. 4 is an enlarged cross-sectional view showing the pin end 102 of the drill string component 100 with the transmission element 300 and transmission line 200 removed. In this embodiment, the slot 110*a* and corresponding feature 112*a* are more clearly visible. In this embodiment, the feature 112*a* is a shoulder incorporated into the slot 110*a* that causes the slot 110*a* to get wider as it approaches the pin end 102. This shoulder may engage a corresponding feature 304 (e.g., a tension anchor 304 as shown in FIG. 3) coupled to or incorporated into an end of the transmission line 200. The shape, configuration, and location of the features 112*a*, 304 are provided by way of example and not limitation. Other shapes, configurations, and locations for the features 112*a*, 304 are possible and within the scope of the invention.

Figure 5:
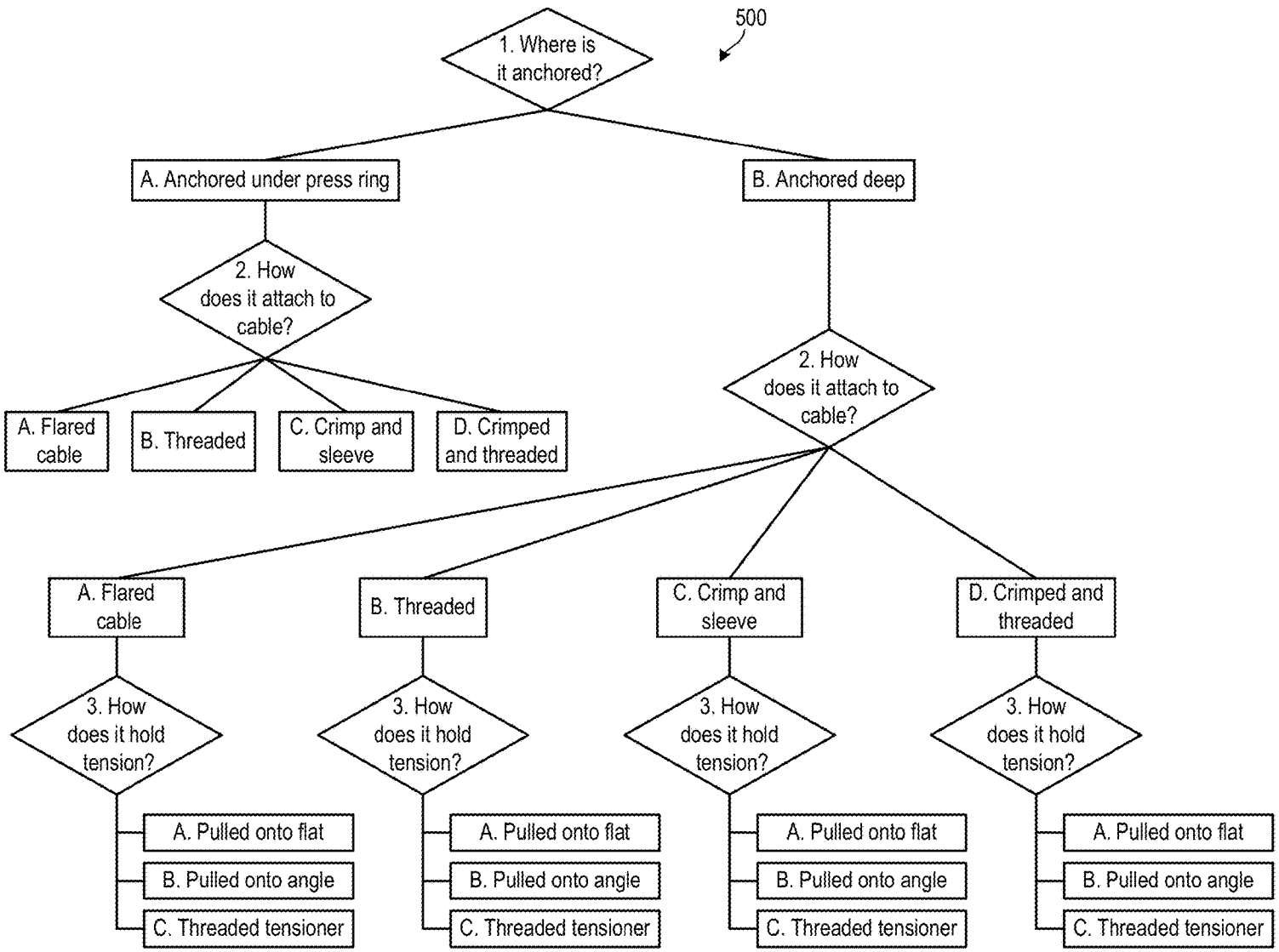
FIG. 5 is a high-level block diagram showing various design choices for installing a transmission line in a drill string component.

Referring to FIG. 5, a high-level block diagram showing various design choices for installing a transmission line 200 in a drill string component 100 is illustrated. As shown, at a highest level, a design methodology 500 may designate where a transmission line 200 is anchored within the drill string component 100. In certain embodiments, the transmission line 200 is anchored underneath a press ring at or near the leading face 302 of the pin end 102, as will be discussed in association with FIGS. 20A through 24B. In such embodiments, a tension anchor 304, used to place tension on the transmission line 200, may be attached to the transmission line 200 using, for example, a flare, threads, a crimp and sleeve, a crimp and threads, and/or the like. These different types of tension anchors 304 will be discussed in association with FIGS. 6A through 7B.

In other embodiments, the transmission line 200 is anchored deeper within the drill string component 100, as will be discussed in association with FIGS. 10A through 19. In such embodiments, a tension anchor 304 may be attached to the transmission line 200 using, for example, a flare, threads, a crimp and sleeve, a crimp and threads, and/or the like, as shown in FIGS. 6A through 7B. Various different configurations/techniques may be used to hold tension on the transmission line 200. For example, a tension anchor 304 may be pulled onto a flat surface to place tension on the transmission line 200, as will be discussed in association with FIGS. 10A through 13B. Alternatively, a tension anchor 304 may be pulled onto an angled surface to place tension on the transmission line 200, as will be discussed in association with FIGS. 14 through 17. In yet other embodiments, a threaded tensioner may be used to place tension on the transmission line 200, as will be discussed in association with FIGS. 18 and 19. The design choices shown in FIG. 5 are provided by way of example and not limitation. Other design choices are possible and within the scope of the invention.

Figure 6A:
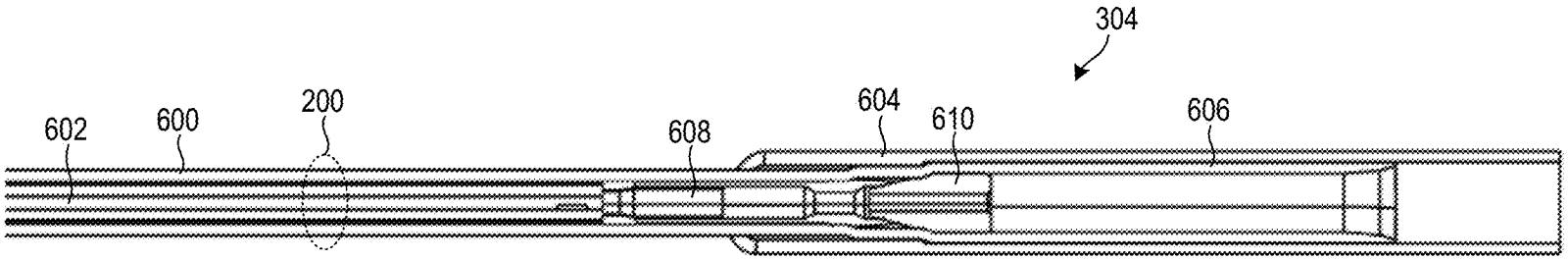
FIG. 6A is a cross-sectional view showing a tension anchor held to the transmission line using a flare.

Referring to FIG. 6A, one embodiment of a tension anchor 304 is illustrated. In this embodiment, the tension anchor 304 is attached to a transmission line 200 using a flare. As shown, the transmission line 200 includes an outer armor 600 (e.g., metal tubing) that protects internal wiring 602 such as coaxial cable. An end 606 of the outer armor 600 may be machined and flared with a tool to retain a sleeve 604 on the end of the transmission line 200. The sleeve 604 may be slipped over the transmission line 200 prior to flaring the end 606. The sleeve 604 may rest against a shoulder 112 within the slot 110*a* to hold tension in the transmission line 200. A connector 608 (e.g., a mill-max connector 608) may be inserted into the flared end 606 of the outer armor 600 to connect to the internal wiring 602 of the transmission line 200. A cone element 610, such as a ceramic cone element 610, may be inserted into the flared end 606 to prevent the flared portion of the outer armor 600 from collapsing and pulling through the sleeve 604. This cone element 610 may have an internal bore to enable a conductive dagger element (not shown) of a transmission element 300 to pass through the internal bore to contact and connect to the connector 608, and thereby connect to the internal wiring 602.

Figure 6B:
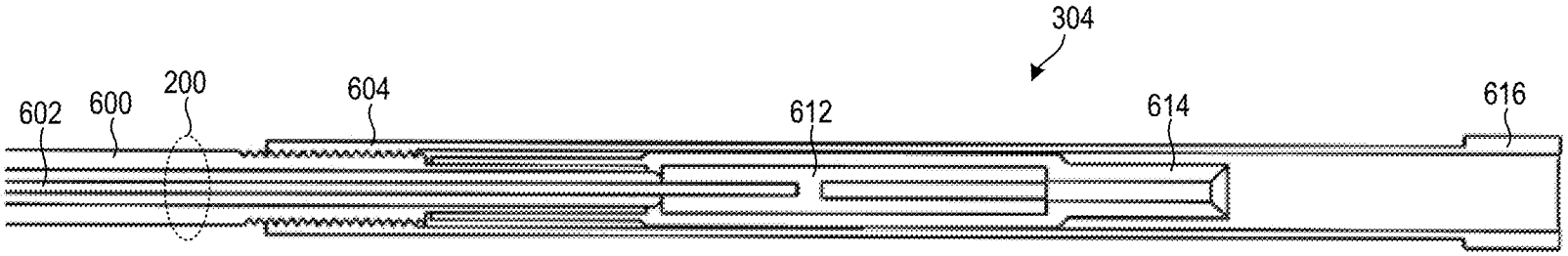
FIG. 6B is a cross-sectional view showing a tension anchor threaded onto the transmission line.

Referring to FIG. 6B, another embodiment of a tension anchor 304 is illustrated. In this embodiment, the tension anchor 304 is threaded onto the transmission line 200. More specifically, the outer armor 600 of the transmission line 200 includes external threads that mate with corresponding internal threads of a sleeve 604. A connector 612, 614, such as an insulated boot connector 612, 614, may enable a conductive dagger element (not shown) of a transmission element 300 to connect to the internal wiring 602. In the illustrated embodiment, the sleeve 604 includes a shoulder 616 that mates with a corresponding shoulder 112 in the slot 110*a* in order to hold tension in the transmission line 200. This embodiment of the tension anchor 304 is designed for anchoring under a press ring, although the tension anchor 304 may also be designed for deeper anchoring within the drill string component 100.

Figure 7A:
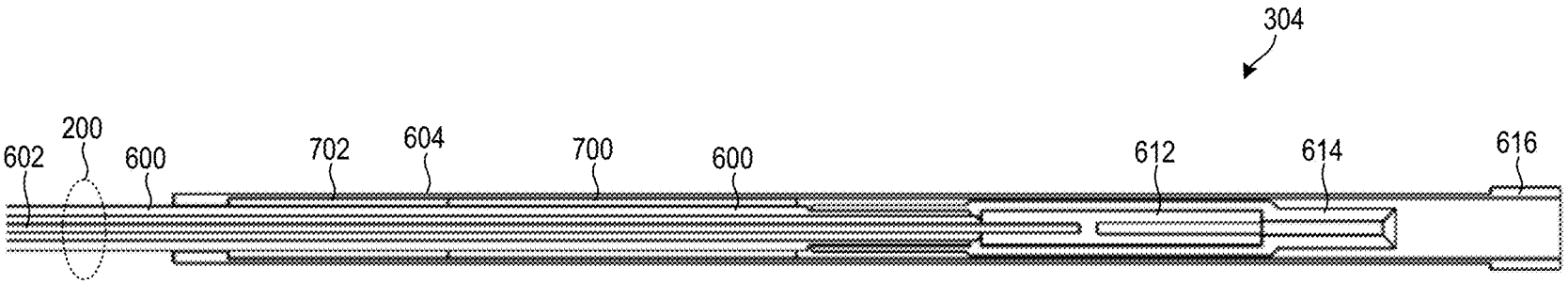
FIG. 7A is a cross-sectional view showing a tension anchor crimped onto the transmission line.

Referring to FIG. 7A, another embodiment of a tension anchor 304 is illustrated. In this embodiment, the tension anchor 304 is crimped onto the transmission line 200. An outer sleeve 604 is initially slipped over the transmission line 200. An inner sleeve 700 is then slipped over the transmission line 200 and crimped onto the outer diameter of the transmission line 200. The outer sleeve 604 may then be slid toward the end of the transmission line 200 until it comes into contact with the inner sleeve 700. In certain embodiments, a spacer 702 may be inserted between the outer sleeve 604 and the inner sleeve 700 to adjust the placement of the outer sleeve 604 relative to the transmission line 200. The length of the spacer may be adjusted to modify the placement. A connector 612, 614, such as an insulated boot connector 612, 614, may enable a conductive dagger element (not shown) of a transmission element 300 to connect to the internal wiring 602 of the transmission line 200.

Figure 7B:
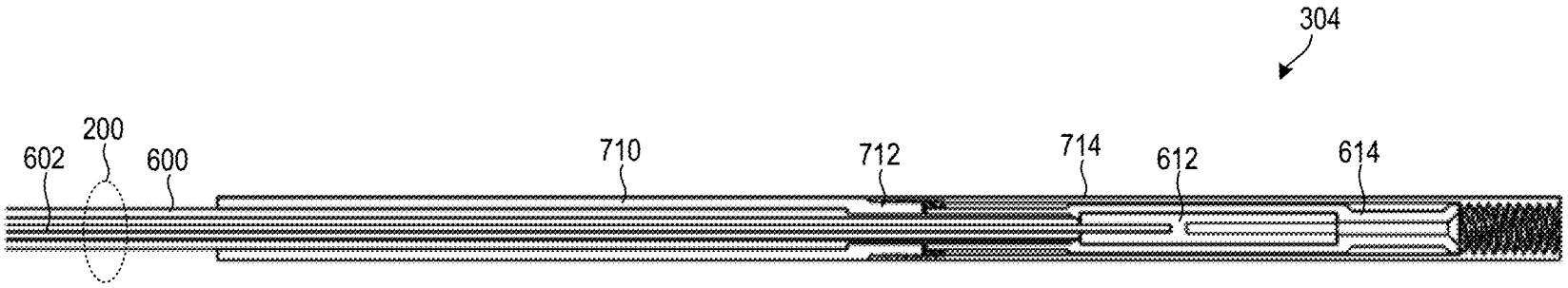
FIG. 7B is a cross-sectional view showing a tension anchor crimped and threaded onto the transmission line.

Referring to FIG. 7B, another embodiment of a tension anchor 304 is illustrated. In this embodiment, the tension anchor 304 is crimped and threaded onto the transmission line 200. A sleeve 710 is initially slipped over the transmission line 200 and crimped onto the transmission line 200. This sleeve 710 is externally threaded on the end 712. An internally threaded second sleeve 714 is then screwed onto the sleeve 710. This second sleeve 714 may be used to cover and protect a connector 612, 614, such as an insulated boot connector 612, 614. The connector 612, 614 may enable a conductive dagger element (not shown) of a transmission element 300 to connect to the internal wiring 602 of the transmission line 200.

Figure 8:
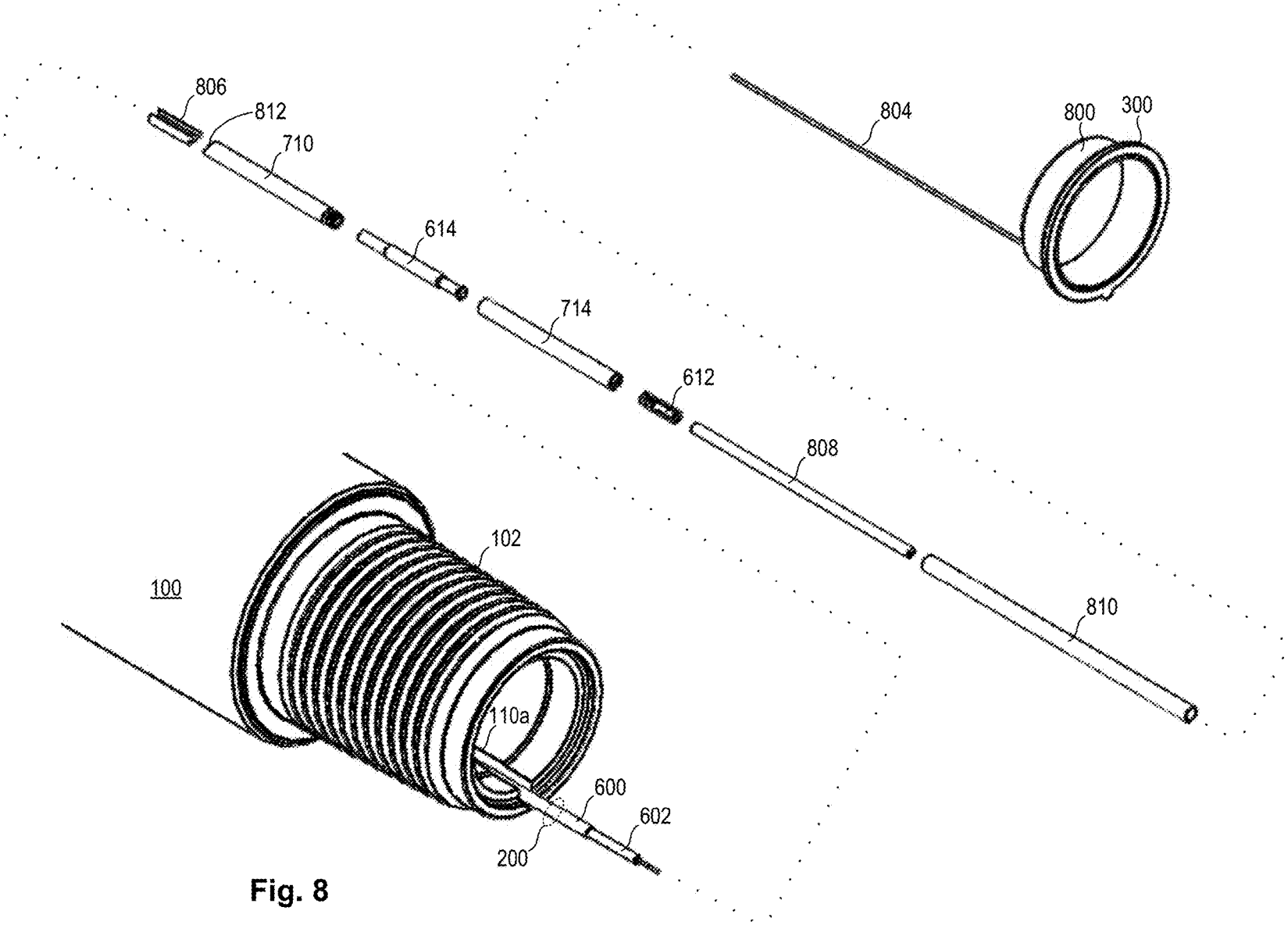
FIG. 8 is an exploded view showing one embodiment of a transmission line retention system in accordance with the invention.

FIG. 8 is an exploded view showing one embodiment of a transmission line retention system in accordance with the invention. The exploded view shown in FIG. 8 is presented to show one example of a retention system in accordance with the invention and is not intended to be limiting.

In the illustrated embodiment, the retention system is anchored deep (i.e., below the press ring 800) in the drill string component 100. The illustrated embodiment also uses a crimped and threaded tension anchor 304 as discussed in association with FIG. 7B. In addition, the tension anchor 304 utilizes a pair of angled surfaces that are oriented to keep the transmission line 200 retained within the slot 110*a* when tension is placed on the transmission line 200. Such an embodiment will be discussed in more detail in association with FIGS. 14 through 17.

FIG. 8 further shows a press ring 800 for insertion into the internal diameter 108 of the drill string component 100, and a transmission element 300 for transmitting signals across the tool joint. A conductive dagger element 804 extends from the transmission element 300 to the connector 612, 614. An insulated sheath 808 may surround the dagger element 804, and an outer protective sheath 810 (e.g., metal tubing) may surround the insulated sheath 808. Further shown are the sleeves 710, 714 as described in association with FIG. 7B.

As shown in FIG. 8, in certain embodiments, an end 812 of the sleeve 710 may be angled to contact a corresponding angle of an insert 806. This angled insert 806 may be placed within the slot 110*a* as will be explained in more detail in association with FIGS. 14 through 17. The orientation of the angled surfaces may keep the transmission line 200 retained within the slot 110*a* when tension is placed on the transmission line 200.

Figure 9:
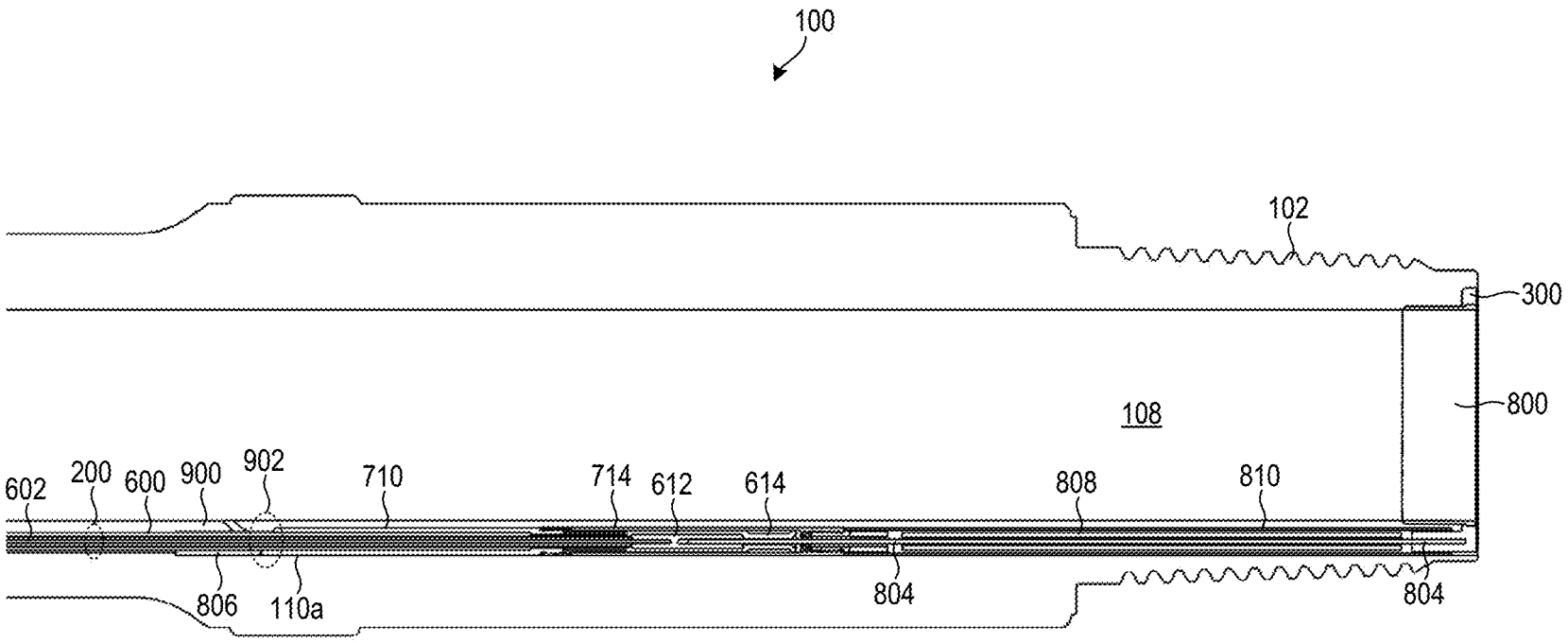
FIG. 9 is a cross-sectional view showing one embodiment of a drill string component with the transmission line and transmission element installed.

FIG. 9 is a cross-sectional view showing the retention system of FIG. 8 assembled in the drill string component 100. Each of the components shown in FIG. 8 are shown in FIG. 9 with the same numbering. Notably, FIG. 9 shows the angled insert 806 within the slot 110*a*. As shown in FIG. 9, the angled insert 806 is retained within the slot 110*a* by overhanging material 900 (hereinafter referred to as an "overhang 900") over the angled insert 806. The angled insert 806 may be slid into the slot 110*a* beneath the overhang 900. The overhang 900 may be sized such that it allows the smaller diameter transmission line 200 to fit into the slot 110*a* while preventing the larger diameter angled insert 806 from exiting the slot 110*a*. A slot may be provided in the angled insert 806 to enable the transmission line 200 to be placed into the angled insert 806 as shown in FIG. 8. As further shown in FIG. 9, the orientation of the angles 902 of the insert 806 and sleeve 710 keep the transmission line 200 firmly retained within the slot 110*a* when tension is placed on the transmission line 200.

FIGS. 10A through 13B show one embodiment of a transmission line retention system within a drill string component 100, and a method for installing the transmission line 200 in the drill string component 100. In this embodiment, the transmission line 200 is "anchored deep" and the transmission line retention system utilizes the crimped and threaded tension anchor 304 discussed in association with FIG. 7B. As shown, a slot 110*a* is provided in the internal diameter 108 of the drill string component 100. This slot 110*a* includes an overhang 900 to retain the tension anchor 304 within the slot 110*a*.

Figure 10A:
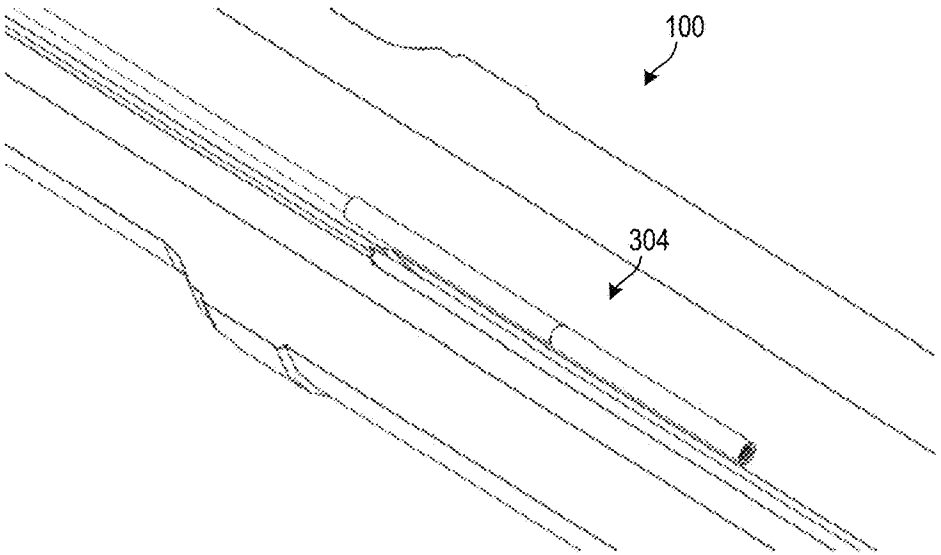
FIGS. 10A through 13B show one embodiment of a transmission line retention system within a drill string component, and a method for installing the transmission line in the drill string component.
Figure 10B:
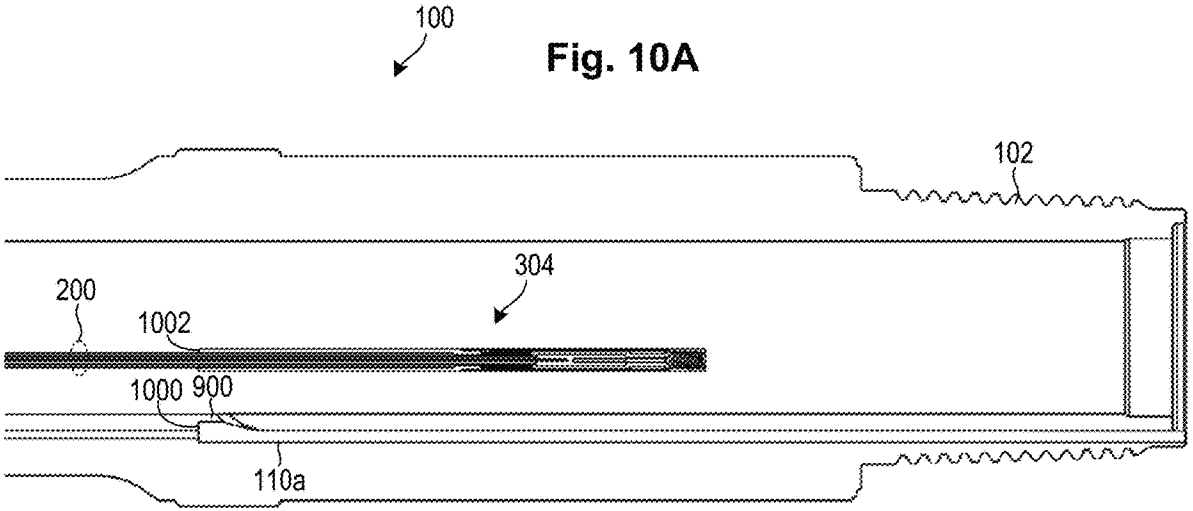

As can be observed in FIGS. 10A and 10B (FIG. 10A is a perspective view of FIG. 10B), the transmission line 200 and tension anchor 304 are initially provided in a relaxed state. In this state, the tension anchor 304 is not able to pass over the overhang 900 and slide into the slot 110*a* (assuming a tension anchor 304 at the other end of the transmission line 200 is already installed into the slot 110*b*).

In order to move the tension anchor 304 past the overhang 900, the transmission line 200 may be stretched (i.e., placed under tension). This stretching may be performed without breaking or permanently deforming the transmission line 200. For example, a thirty-four foot transmission line 200 (with metal outer armor 600) may be stretched on the order of an inch without breaking or permanently deforming the transmission line 200.

Figure 11A:
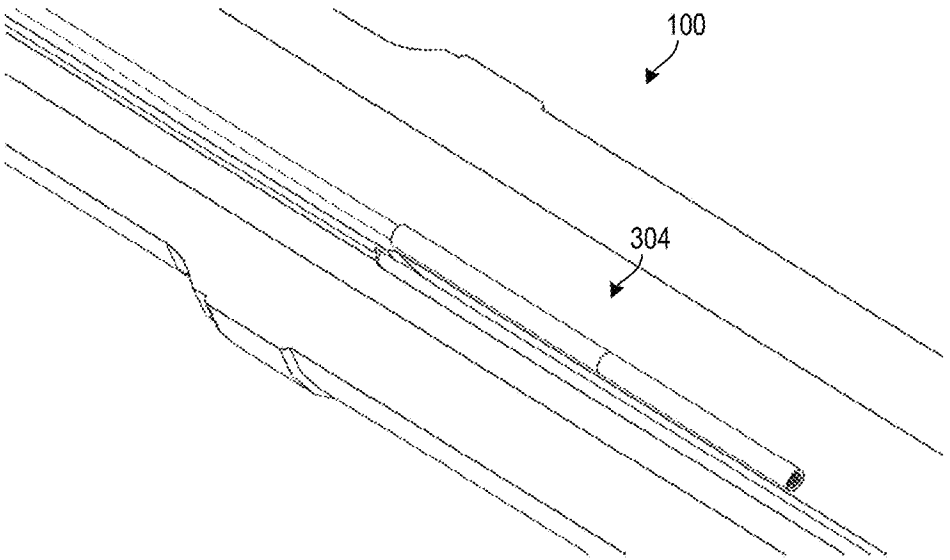
Figure 11B:
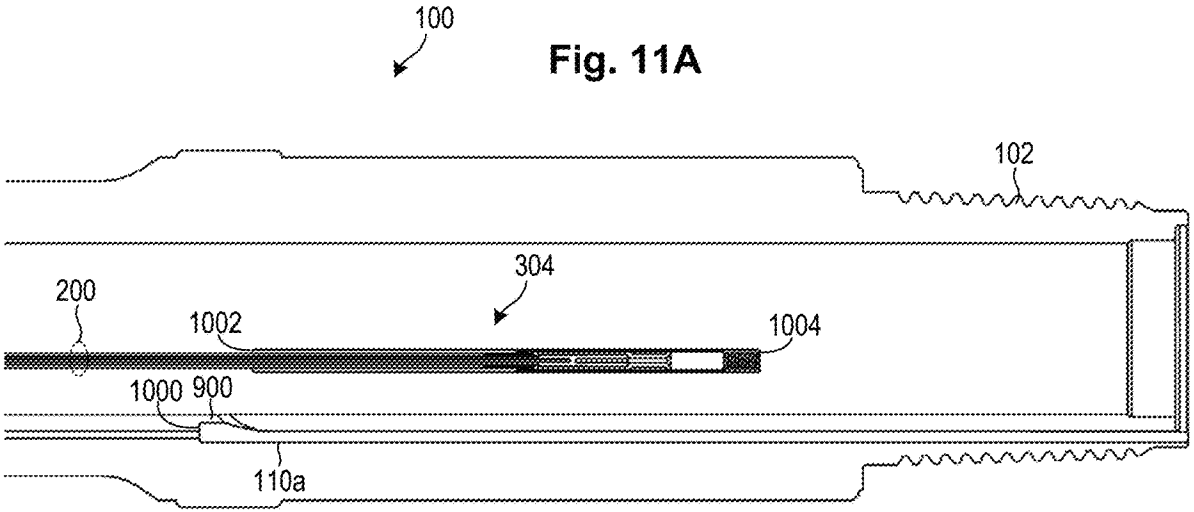

As can be observed in FIGS. 11A and 11B, the transmission line 200 and tension anchor 304 may be stretched so that the rear portion 1002 of the tension anchor 304 moves beyond the overhang 900. In certain embodiments, a tool may be attached to an end 1004 of the tension anchor 304, such as by screwing the tool into the internal threads 1004 of the tension anchor 304, to stretch and place tension on the transmission line 200.

Figure 12A:
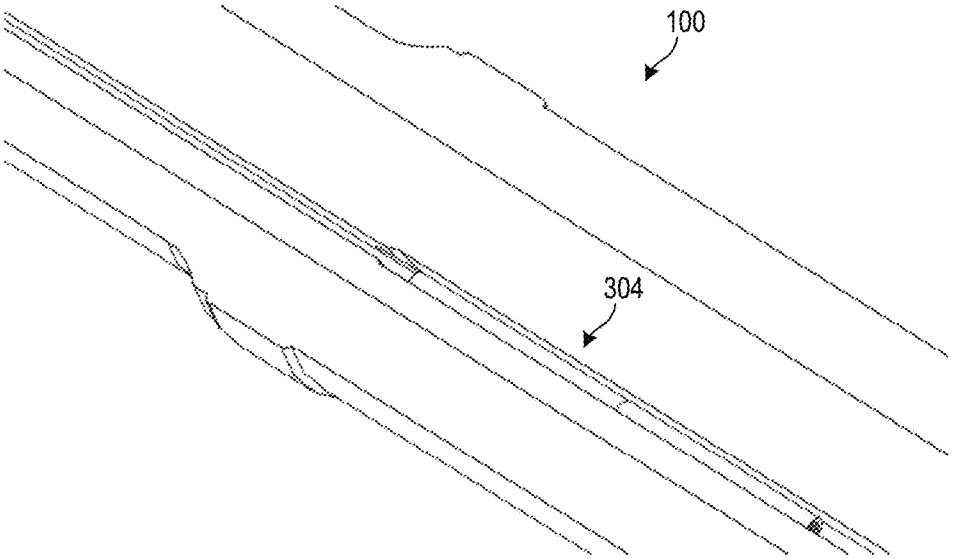
Figure 12B:
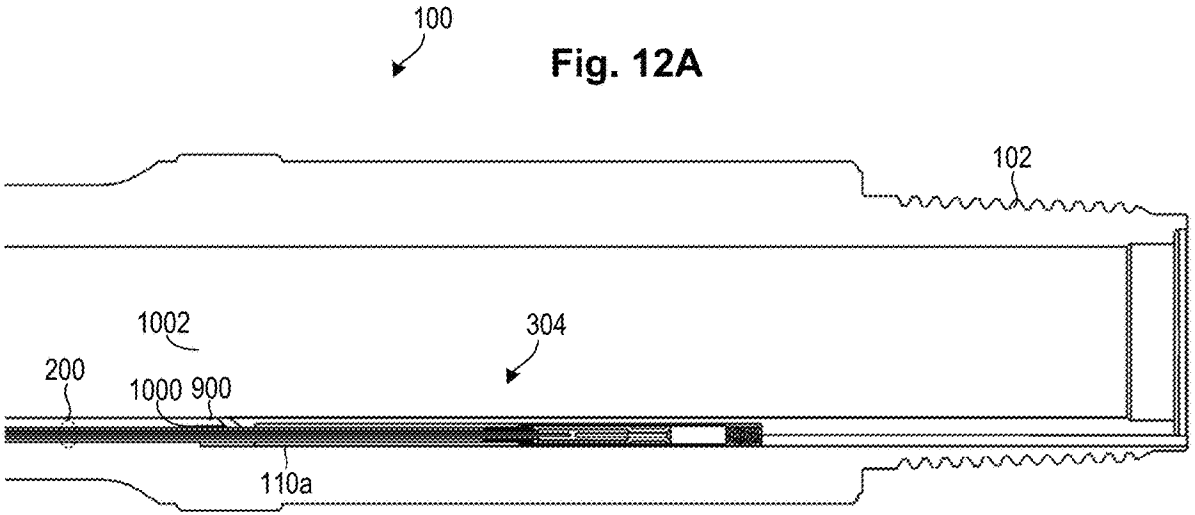
Figure 13A:
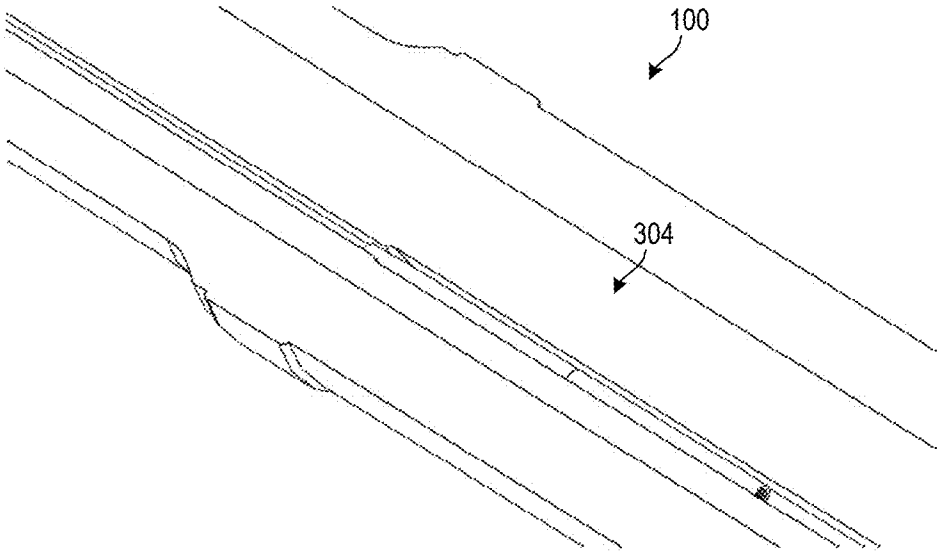
Figure 13B:
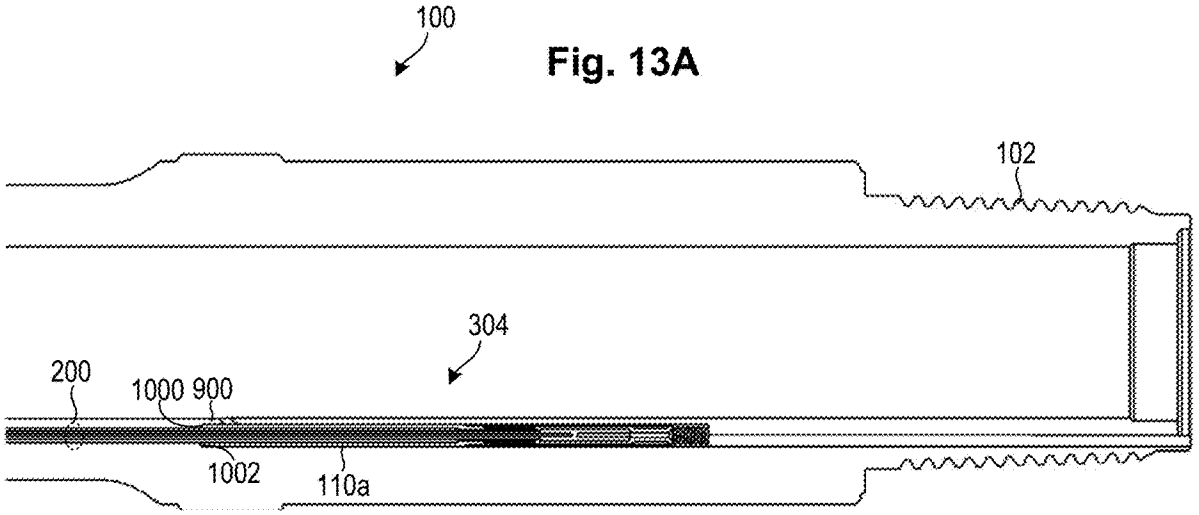

As can be observed in FIGS. 12A and 12B, once past the overhang 900, the tension anchor 304 and transmission line 200 may be inserted into the slot 110*a*. Once in the slot 110*a*, the tension anchor 304 may be released. The tension in the transmission line 200 may then pull the tension anchor 304 into the void between the overhang 900 and the slot 110*a*, as shown in FIGS. 13A and 13B. Because the tension anchor 304 is trapped below the overhang 900, the tension anchor 304 cannot leave the slot 110*a*, thereby securing the end of the transmission line 200.

As shown in FIGS. 10A through 13B, in certain embodiments, the mating surfaces 1000, 1002 between the tension anchor 304 and the slot 110*a* are roughly perpendicular to the transmission line 200. This configuration is anchored deep and "pulled onto [a] flat," as set forth in FIG. 5, since the tension anchor 304 is pulled onto a "flat" (i.e., perpendicular) surface. Because of the overhang 900, the tension anchor 304 is retained within the slot 110*a* until tension is released in the transmission line 200.

FIGS. 14 through 17 show another embodiment of a transmission line retention system within a drill string component 100, and a method for installing the transmission line 200 in the drill string component 100. In this embodiment, the transmission line 200 is anchored deep and "pulled onto [an] angle" as set forth in FIG. 5 of the patent application.

Figure 14:
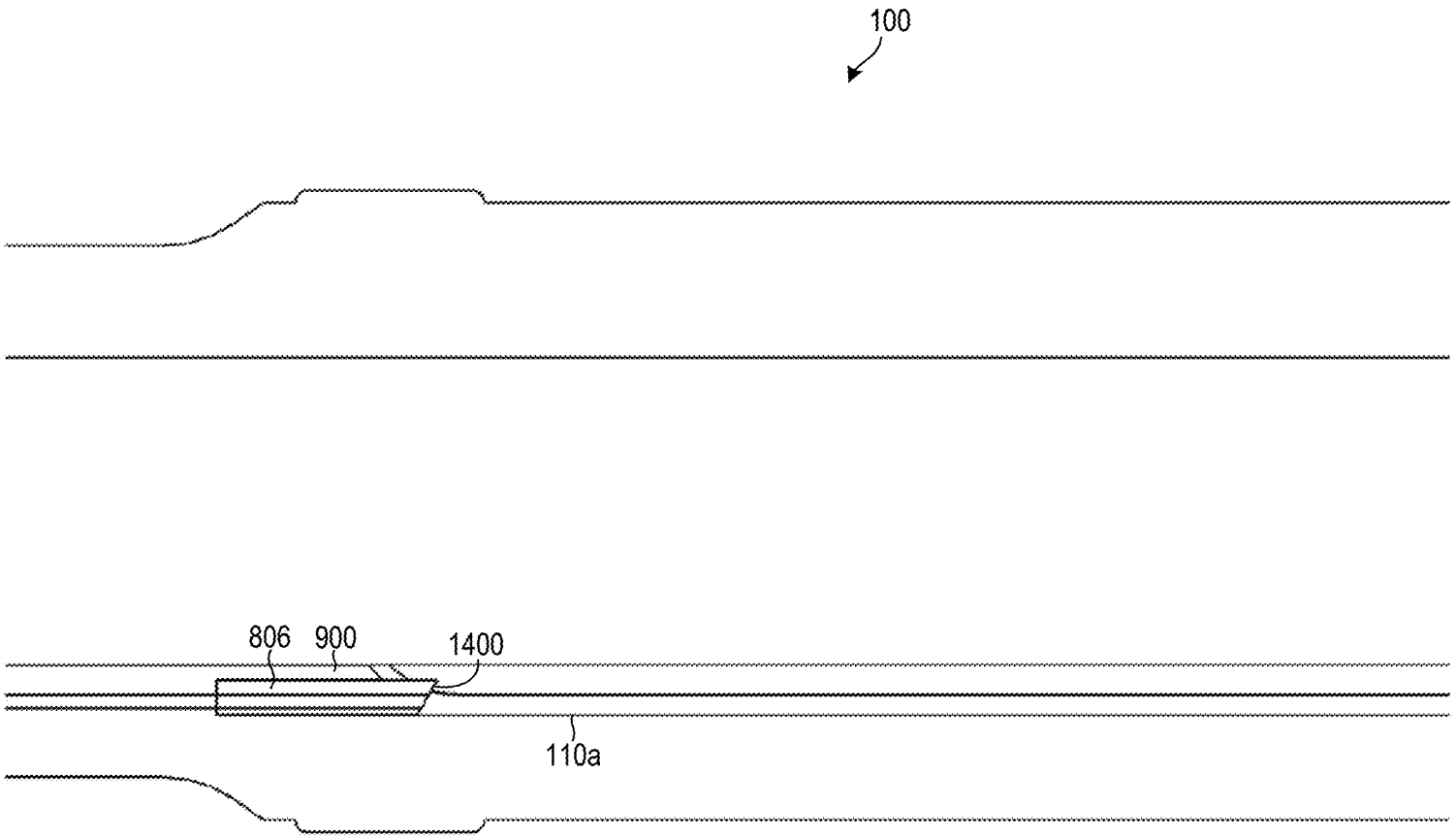
FIGS. 14 through 17 show another embodiment of a transmission line retention system within a drill string component, and a method for installing the transmission line in the drill string component.

For example, referring to FIG. 14, in certain embodiments, an angled insert 806 may be placed into the slot 110*a* under the overhang 900. Because the angled insert 806 is placed under the overhang 900, the angled insert 806 may be retained in the slot 110*a*. Alternatively, the angled insert 806 may be permanently attached to the internal diameter 108 of the drill string component 100 or a shape similar to the angled insert 806 may be milled into the internal diameter 108 of the drill string component 100. As shown in FIG. 14, the angled surface 1400 may be oriented such as to keep the transmission line 200 retained within the slot 110*a* when tension is placed on the transmission line 200.

Figure 15:
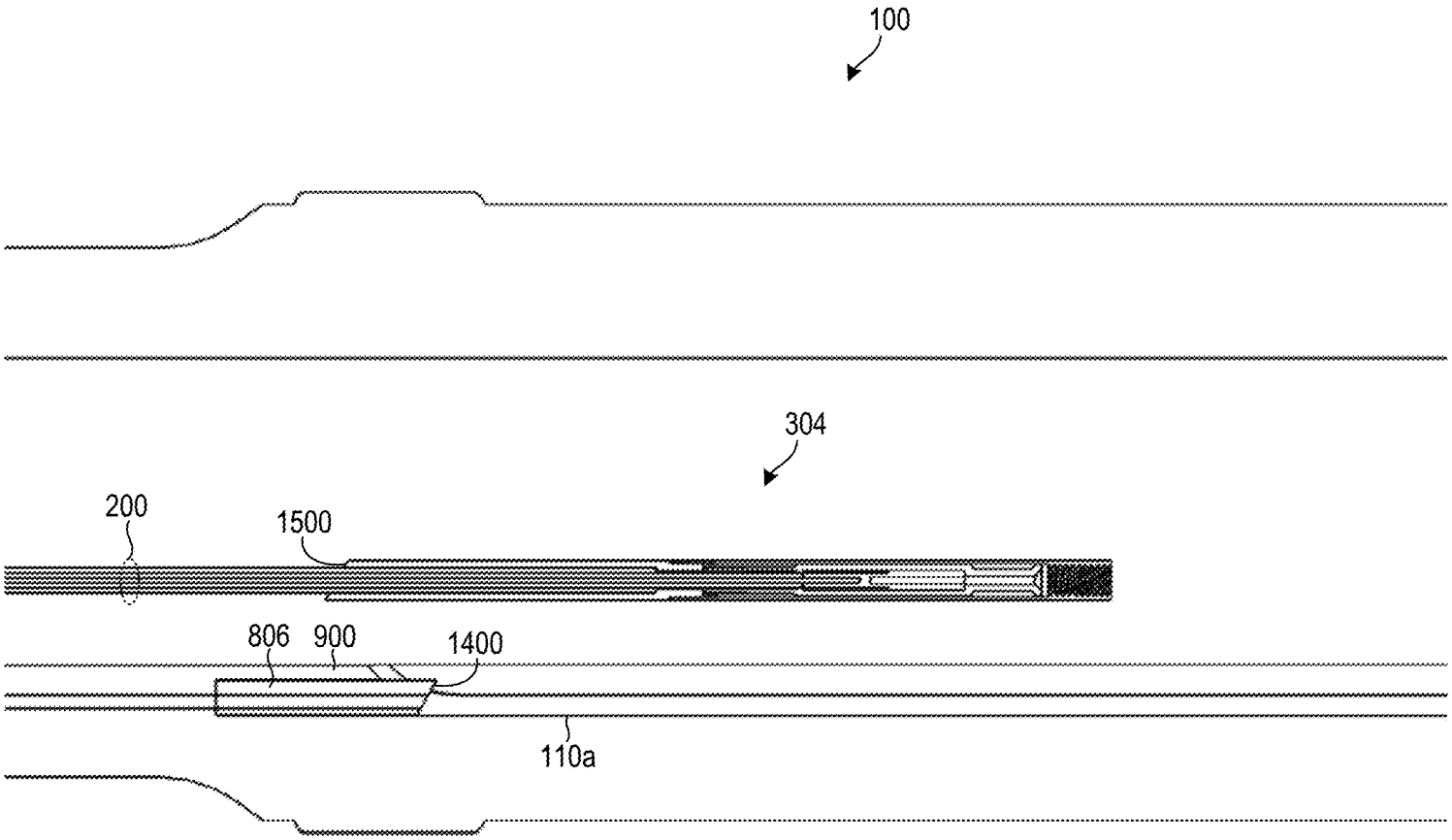
Figure 16:
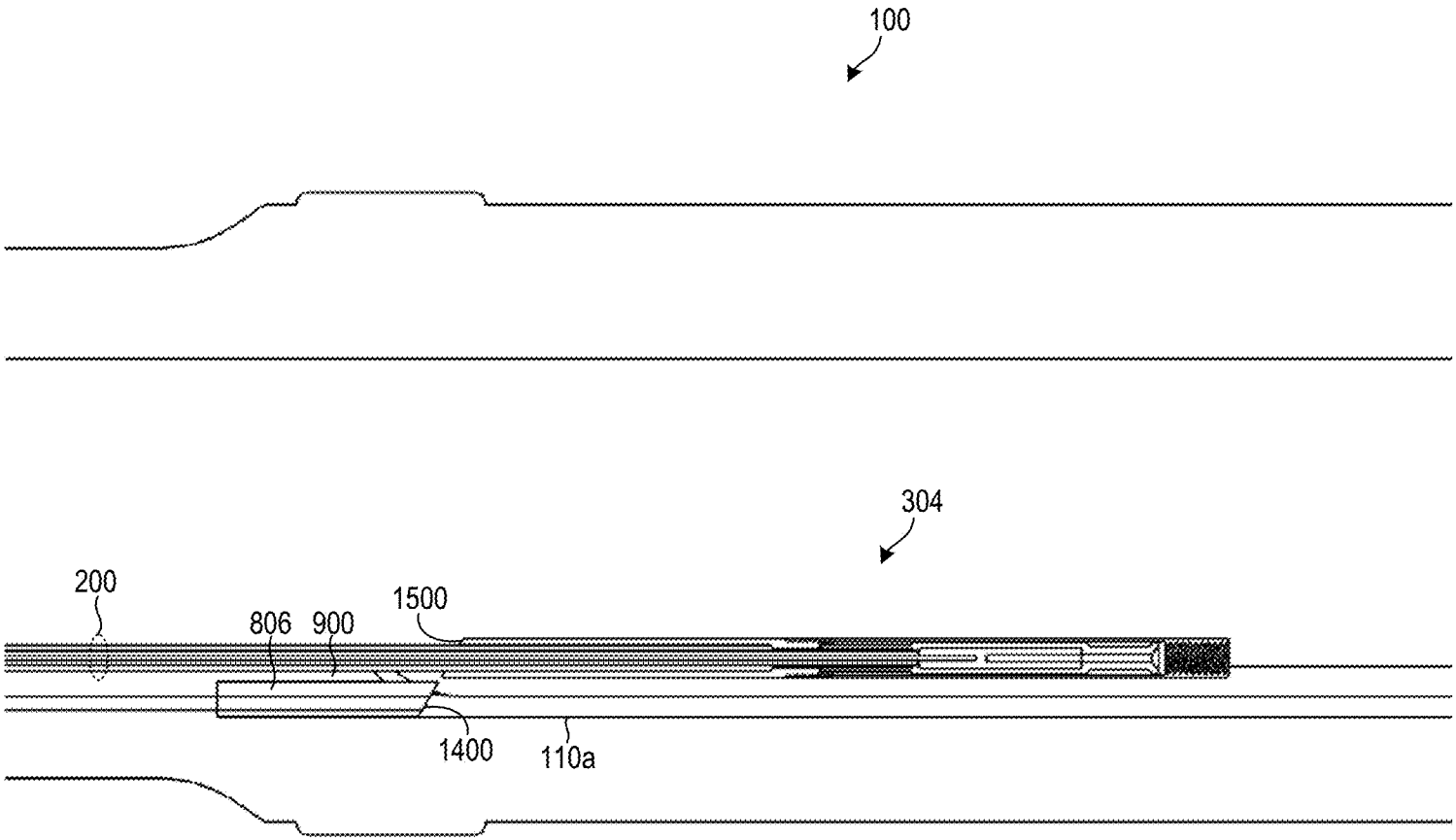
Figure 17:
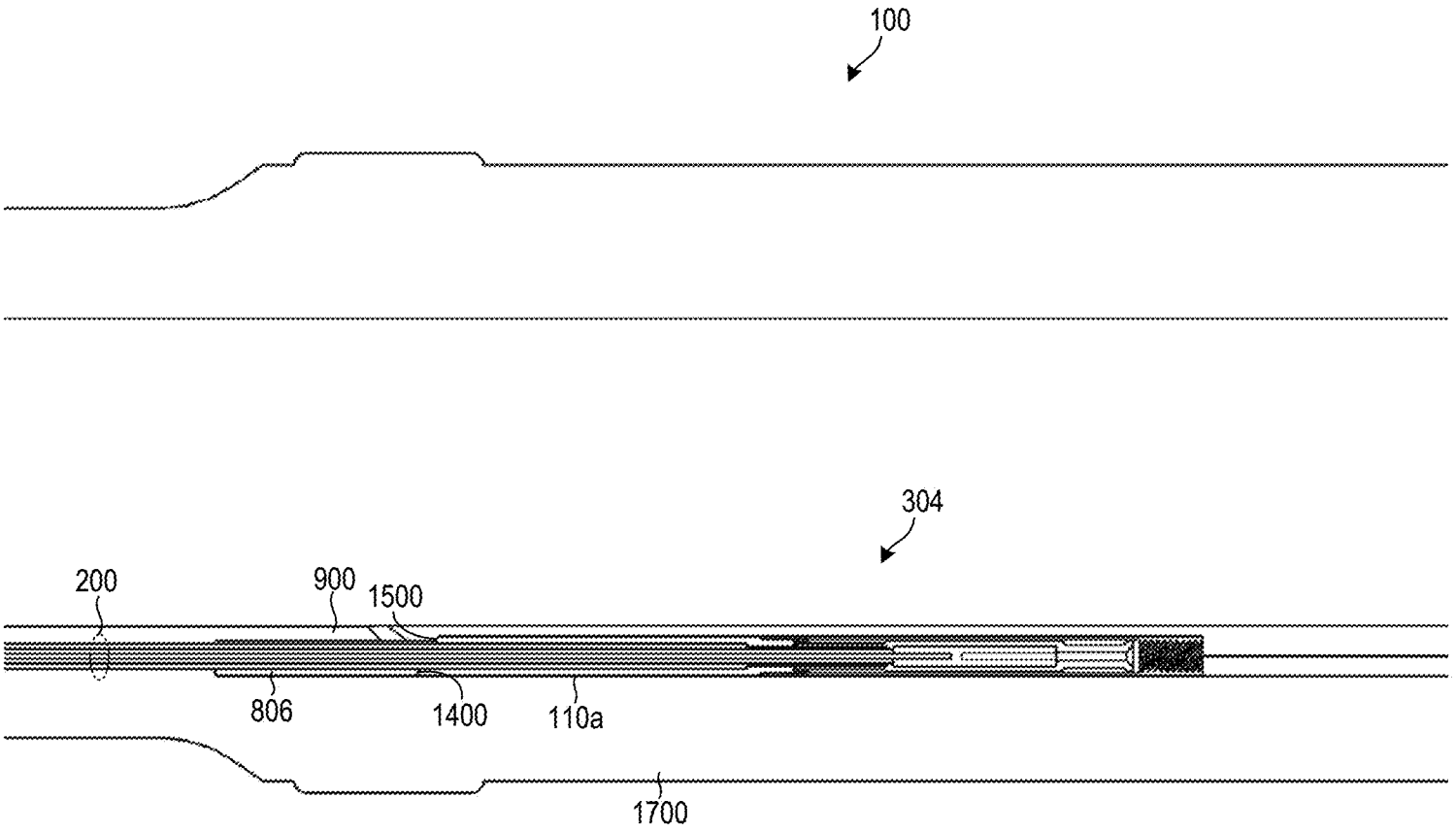

Referring to FIG. 15, in order to anchor a transmission line 200 to the end of the drill string component 100, the tension anchor 304 of a transmission line 200 may be initially brought into proximity of the angled insert 806. Tension may then be placed on the tension anchor 304 and transmission line 200 to move an end 1500 the tension anchor 304 past the angled insert 806 (i.e., towards the end of the drill string component 100), as shown in FIG. 16.

When the tension anchor 304 is past the angled insert 806, the tension anchor 304 may be moved into the slot 110*a* and the tension in the transmission line 200 may be released. This may enable the angled surface 1500 of the tension anchor 304 to come into contact with the angled surface 1400 of the insert 806. Due to the orientation of the angled surfaces 1400, 1500, the tension anchor 304 and transmission line 200 are pulled into the slot 110*a* (i.e., toward the wall of the drill string component 100) as tension is placed on the transmission line 200. In other words, the tension anchor 304 will be urged in the direction of the wall 1700 of the drill string component 100, thereby keeping the tension anchor 304 and transmission line 200 within the slot 110*a*.

Figure 18:
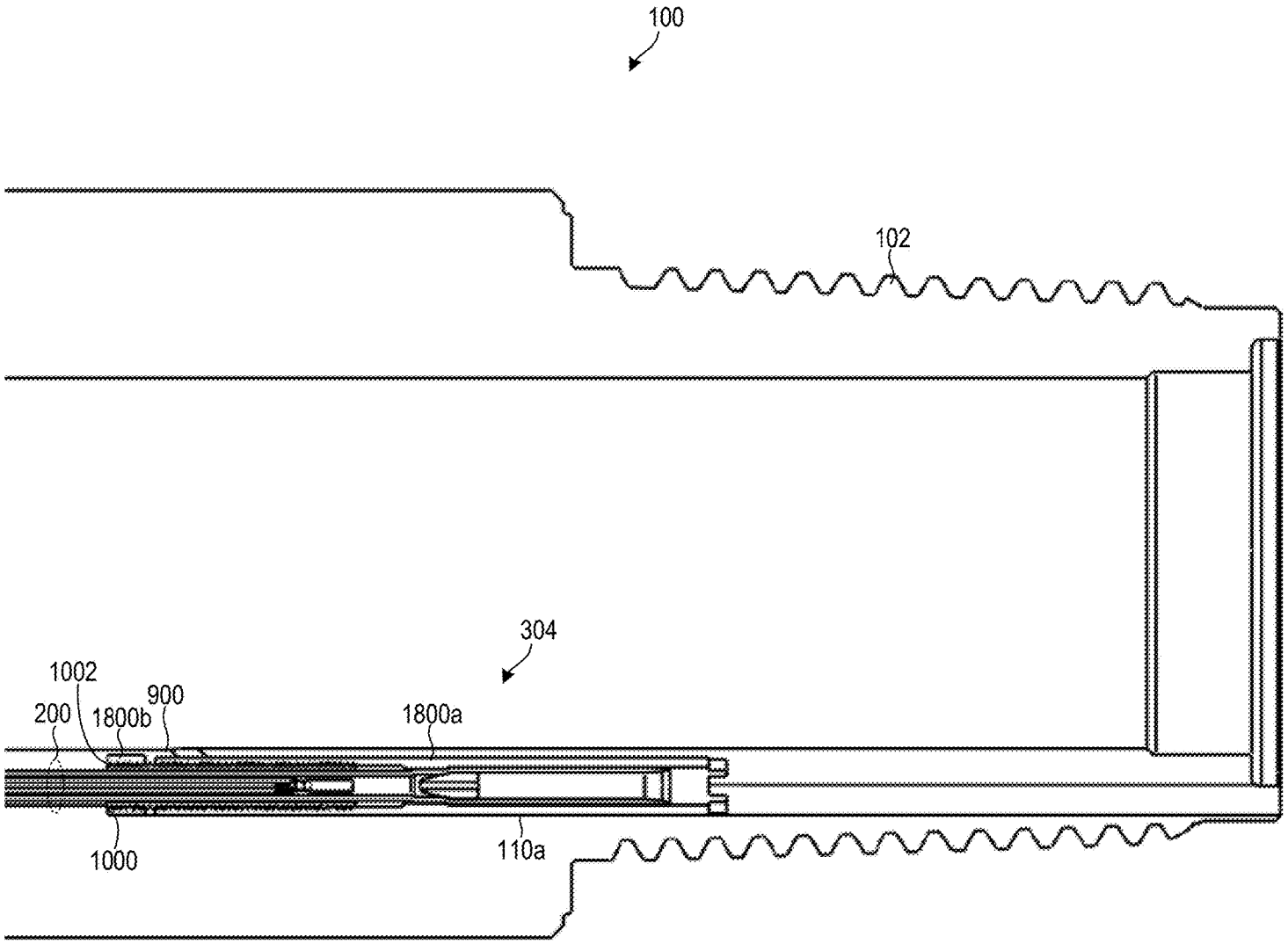
FIGS. 18 and 19 show another embodiment of a transmission line retention system within a drill string component, and a method for installing the transmission line in the drill string component.
Figure 19:
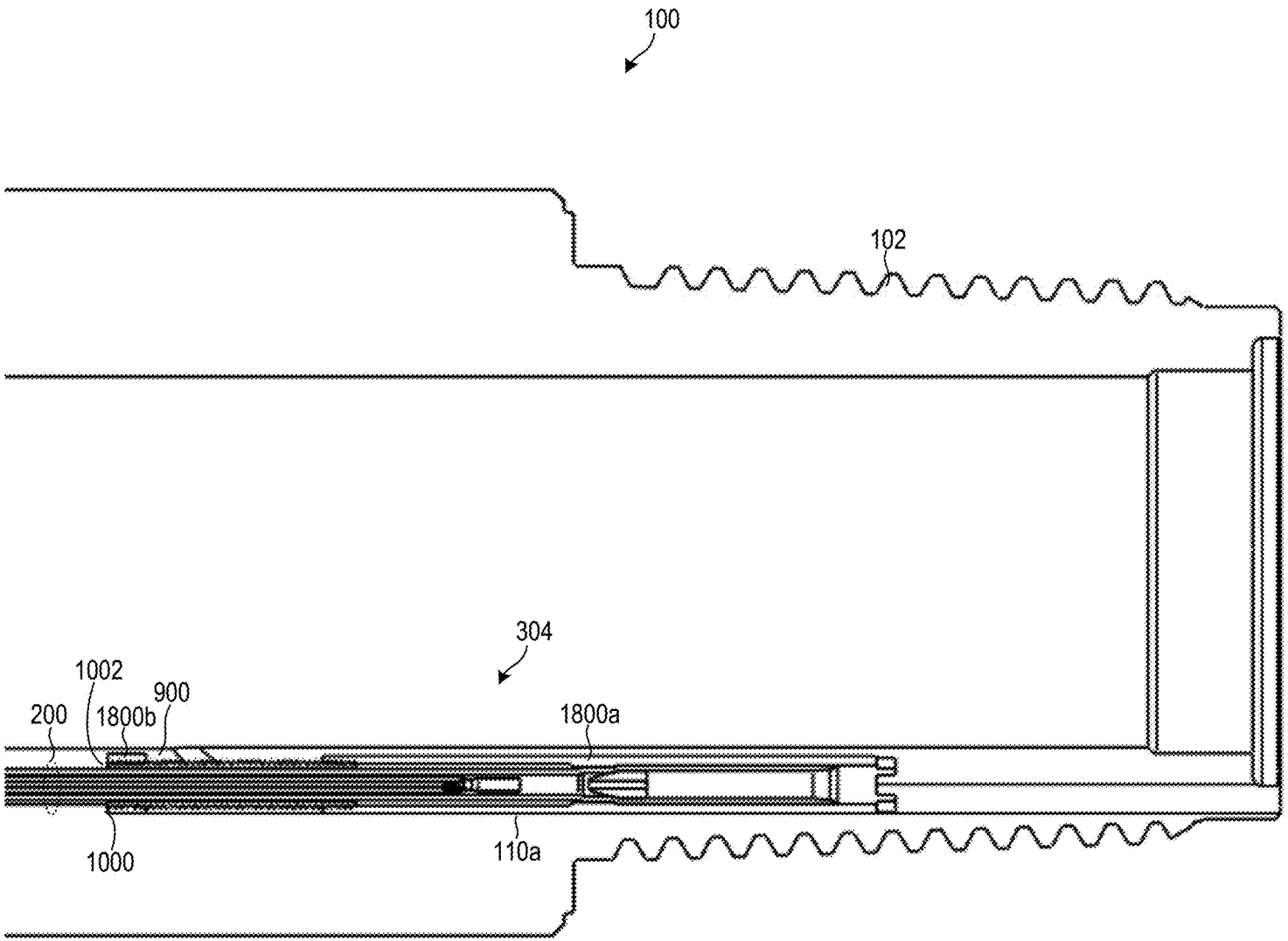

FIGS. 18 and 19 show another embodiment of a transmission line retention system within a drill string component 100, and a method for installing the transmission line 200 in the drill string component 100. In this embodiment, the tension anchor 304 is anchored deep and "pulled onto a flat" as discussed in association with FIG. 5 of the disclosure. After being pulled onto the flat, the tension anchor 304 is then adjusted to increase tension in the transmission line 200.

For example, referring to FIG. 18, a tension anchor 304 attached to a transmission line 200 may initially be inserted into the slot 110*a*. In this example, the slot 110*a* includes an overhang 900 and the mating surfaces 1000, 1002 are perpendicular to the transmission line 200. Furthermore, in this embodiment, the tension anchor 304 includes two components 1800*a*, 1800*b* that are threaded together. After placing the transmission line 200 and tension anchor 304 into the slot 110*a*, the first component 1800*a* of the tension anchor 304 may be rotated relative to the second component 1800*b* using a tool. Due to the threaded connection, this may cause the first component 1800*a* (which is attached to the end of the transmission line 200) to move towards the pin end 102 of the drill string component 100, thereby adding tension to the transmission line 200. This rotation may continue until a desired amount of tension is placed on the transmission line 200, as shown in FIG. 19. To release tension in the transmission line 200, the first component 1800*a* may be rotated in the opposite direction relative to the second component 1800*b*.

FIGS. 20A through 24B show another embodiment of a transmission line retention system within a drill string component 100, and a method for installing the transmission line 200 in the drill string component 100. In this embodiment, the tension anchor 304 is anchored beneath a press ring 800 installed in the end of the drill string component 100.

Figure 20B:
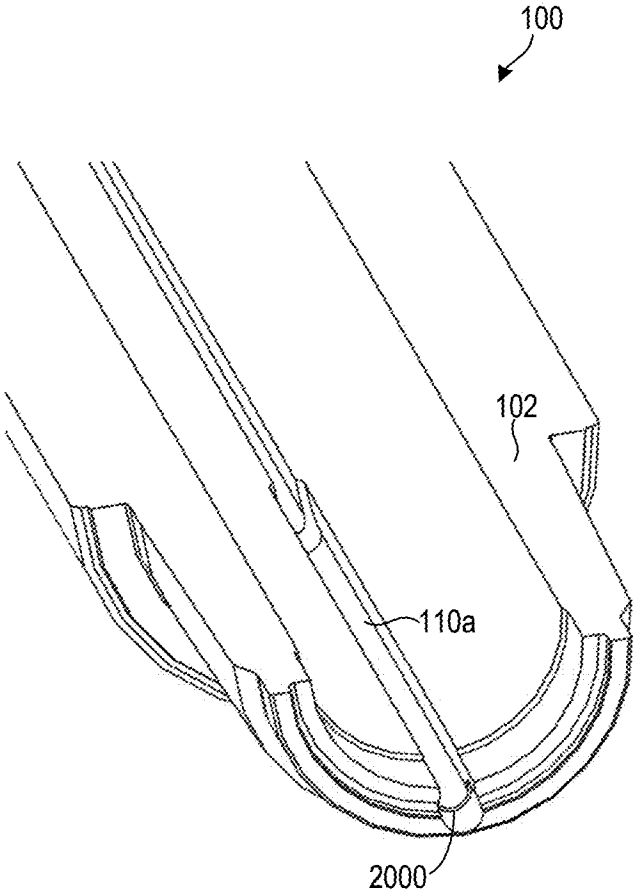
FIGS. 20A through 24B show another embodiment of a transmission line retention system within a drill string component, and a method for installing the transmission line in the drill string component.
Figure 20A:
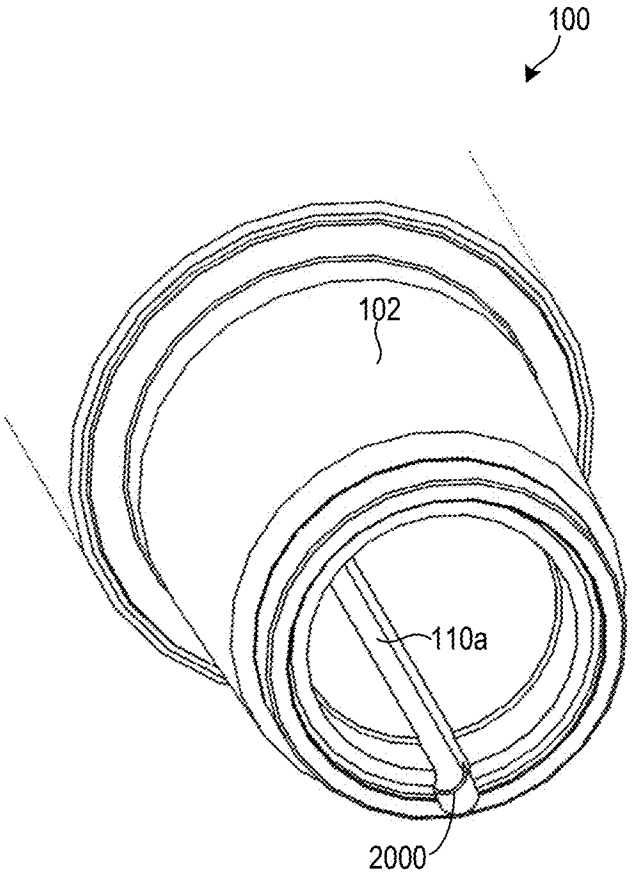

Referring to FIGS. 20A and 20B, as shown, in certain embodiments, a shoulder 2000 may be incorporated into a slot 110*a* in the drill string component 100. In certain embodiments, this shoulder 2000 may be located at or near the end of the drill string component 100.

Figure 21B:
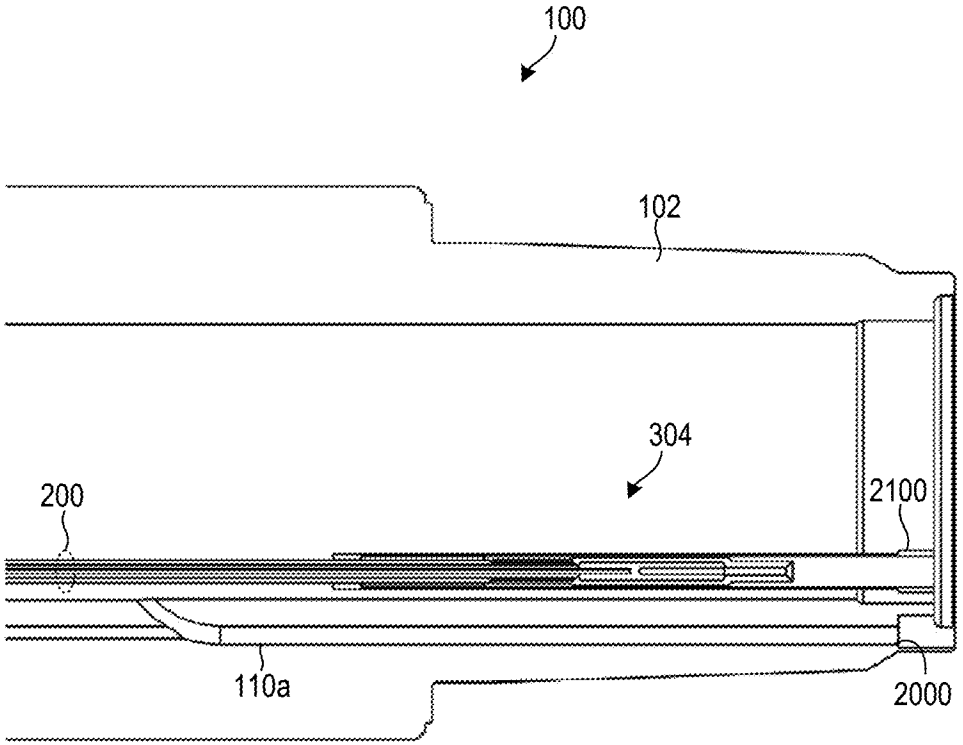
Figure 21A:
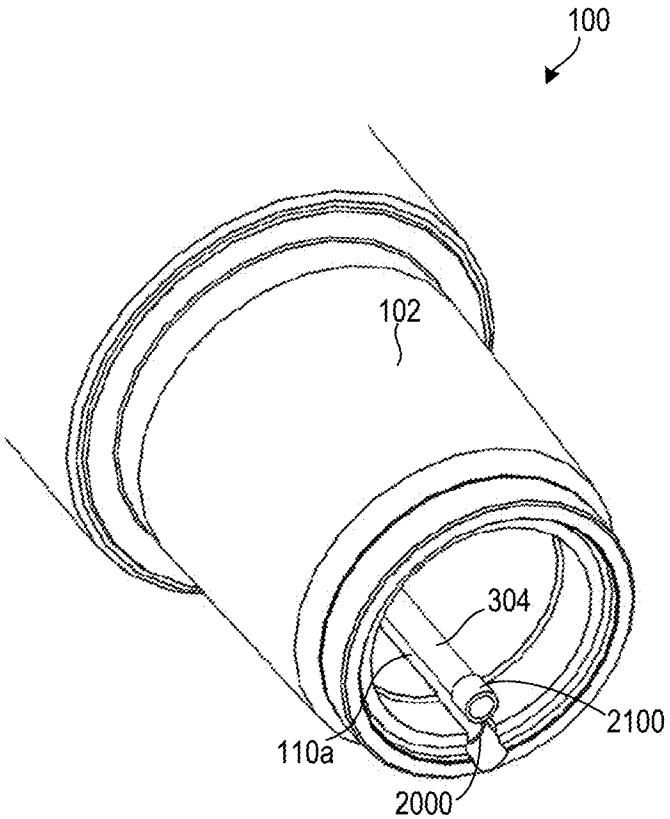

Referring to FIGS. 21A and 21B, a tension anchor 304 and associated transmission line 200 may then be placed in the slot 110*a*. A shoulder 2100 on the tension anchor 304 604 may be aligned with the corresponding shoulder 2000 in the slot 110*a*. In certain embodiments, tension may be placed on the tension anchor 304 and transmission line 200 in order to align the shoulders 2000, 2100.

Figure 22B:
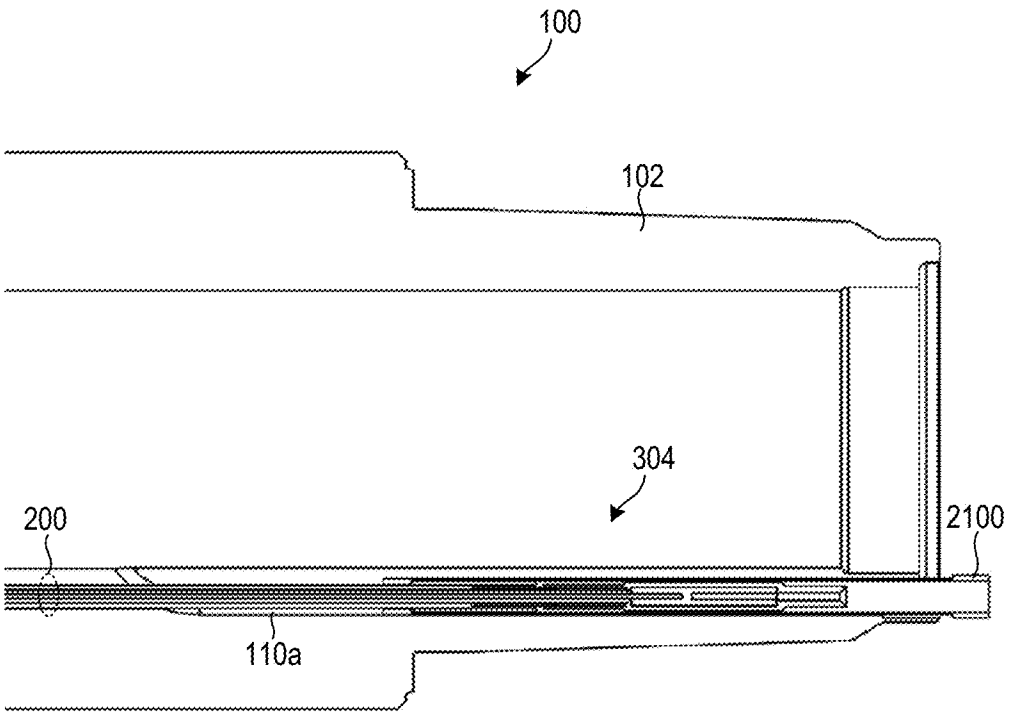
Figure 22A:
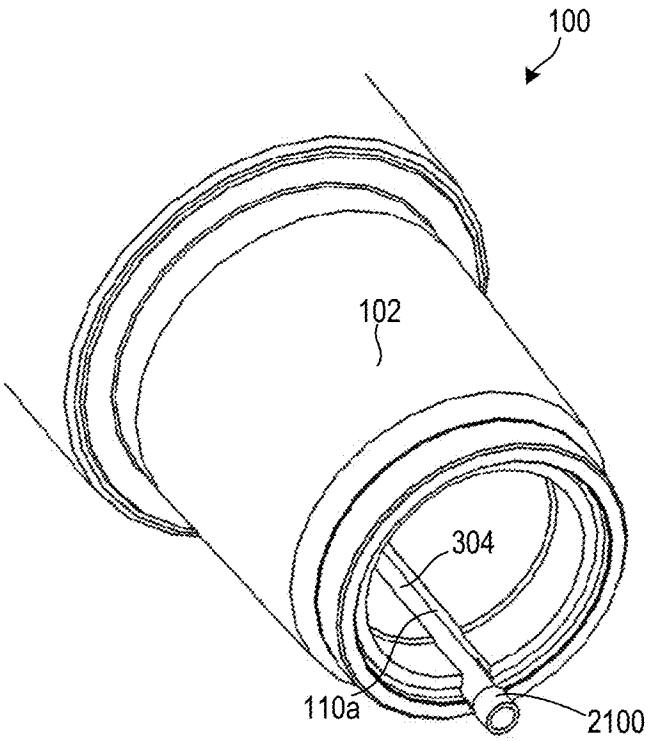
Figure 23B:
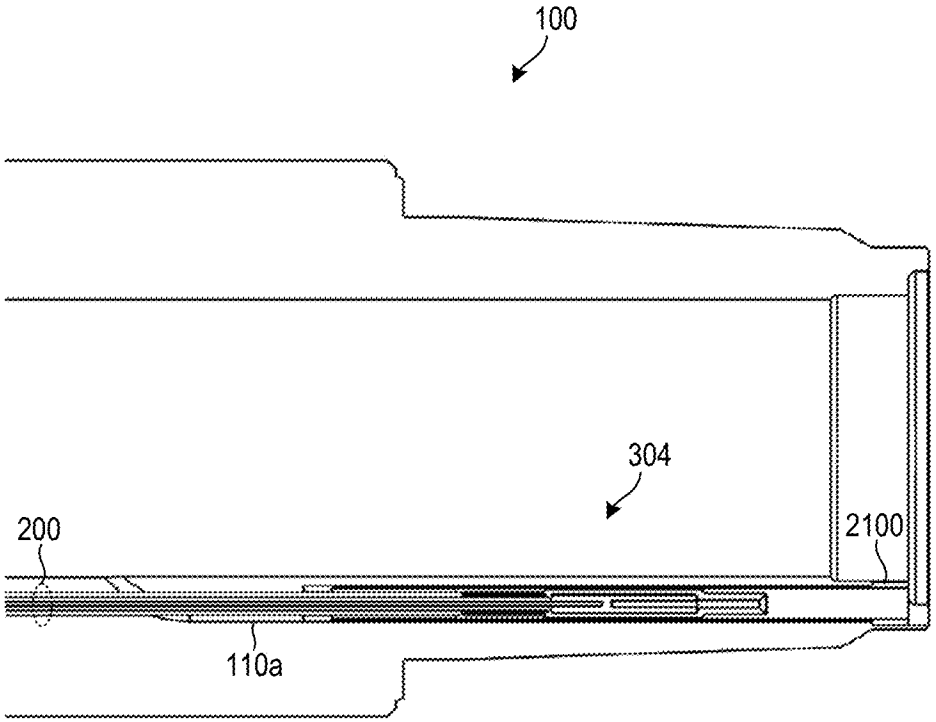
Figure 23A:
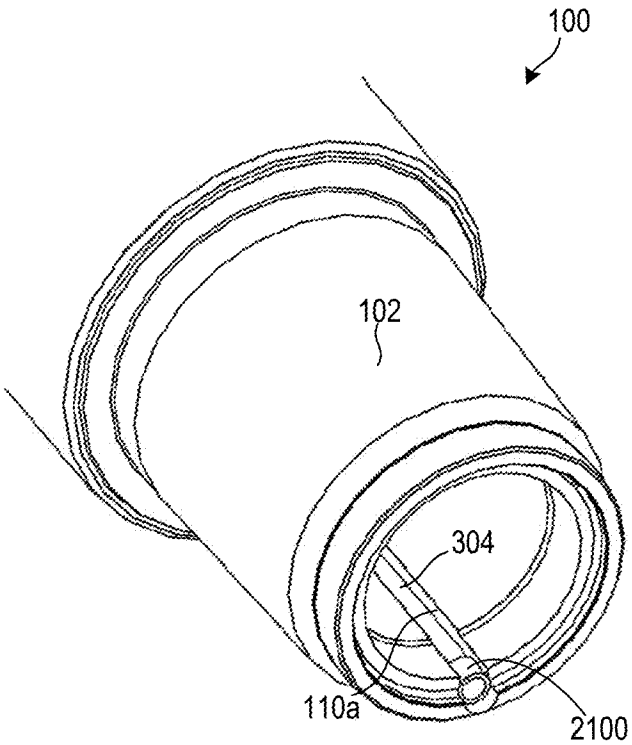
Figure 24B:
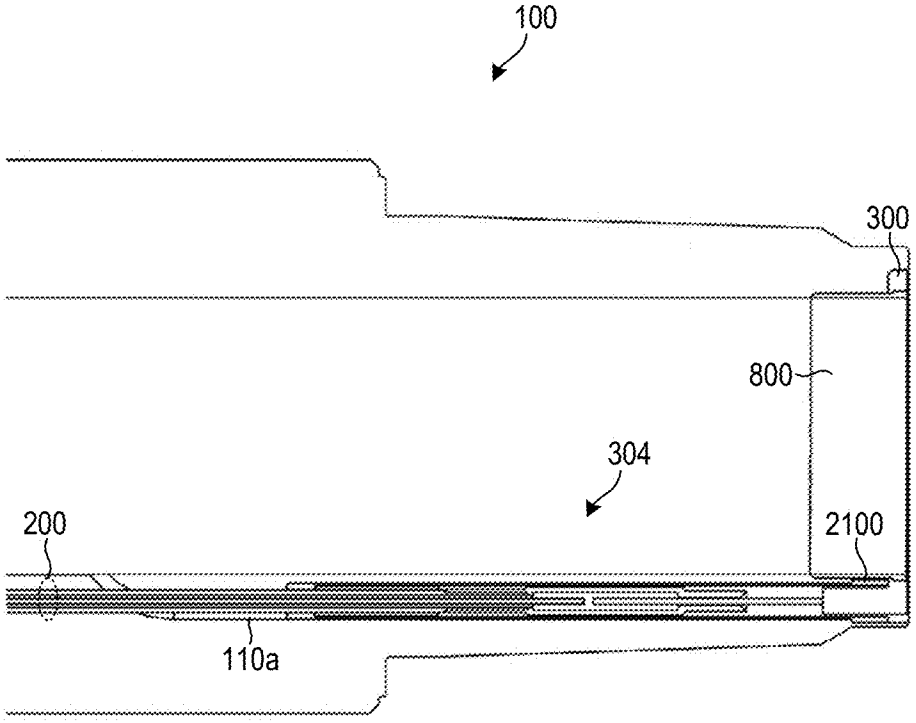
Figure 24A:
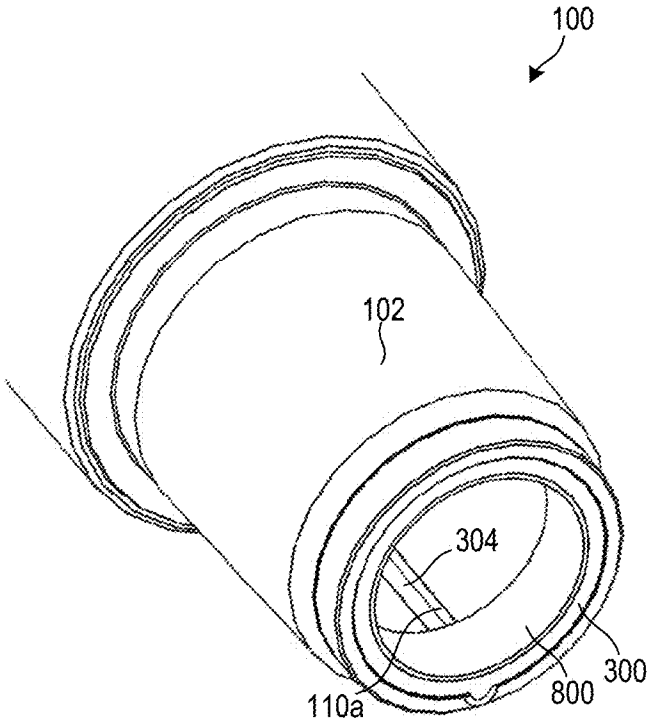

Referring to FIGS. 22A and 22B, once the shoulder 2100 of the tension anchor 304 is aligned with the shoulder 2000 of the slot 110*a*, the tension anchor 304 and transmission line 200 may be placed in the slot 110*a*. Tension in the transmission line 200 may then be released to allow the shoulder 2100 of the tension anchor 304 to seat against the shoulder 2000 of the slot 110*a*, as shown in FIGS. 23A and 23B. Once the shoulder 2100 of the tension anchor 304 is seated against the shoulder 2000 of the slot 110*a*, a press ring 800 may be placed in the internal diameter 108 of the drill string component 100. This press ring 800 may keep the tension anchor 304 with the slot 110*a*, thereby ensuring tension is maintained in the transmission line 200. To release tension in the transmission line 200, the press ring 800 may be removed and the tension anchor 304 may be removed from the slot 110*a*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for retaining an electromagnetic transmission line within a drill string component, the apparatus comprising:

a drill string component comprising:

a bore having an internal surface, a slot in the internal surface of the bore, the slot being configured to receive an electromagnetic transmission line, and a shoulder in the slot; and a tension anchor configured to be engaged with the electromagnetic transmission line, the tension anchor comprising:

an inner sleeve configured to be crimped onto an outer diameter of the electromagnetic transmission line, an outer sleeve configured to be coupled with the inner sleeve, and an electrical connector configured to be electrically coupled with the electromagnetic transmission line, wherein the tension anchor is further configured to be received in the slot in engagement with the shoulder.

2. The apparatus of claim 1, further comprising a spacer configured to be positioned between the inner sleeve and the outer sleeve in a coupled state of the outer sleeve with the inner sleeve.

3. The apparatus of claim 2, wherein the spacer has an adjustable length.

4. The apparatus of claim 3, wherein in an electrically coupled state of the electrical connector with the electromagnetic transmission line, adjustment of the length of the spacer modifies a position of the outer sleeve along the electromagnetic transmission line.

5. The apparatus of claim 1, wherein the slot is open to an internal volume of the bore.

6. The apparatus of claim 1, wherein the electrical connector is configured to electrically couple a wireless transmission element to the electromagnetic transmission line, the wireless transmission element being configured to wirelessly transmit signals.

7. A system for retaining an electromagnetic transmission line within a drill string component, the system comprising:

a drill string, the drill string comprising a drill string component comprising:

a bore having an internal surface, a slot in the internal surface of the bore, and a shoulder in the slot;

an electromagnetic transmission line receivable by the slot of the drill string component; and a tension anchor engaged with the electromagnetic transmission line, the tension anchor comprising:

an inner sleeve crimped onto the electromagnetic transmission line;

an outer sleeve coupled with the inner sleeve, and an electrical connector configured to electrically couple with the electromagnetic transmission line, wherein the tension anchor is configured to engage the shoulder in the slot of the drill string component and hold tension in the electromagnetic transmission line in a state of the electromagnetic transmission line received by the slot.

8. The system of claim 7, wherein the outer sleeve of the tension anchor comprises a surface protruding laterally outwardly from the tension anchor and configured to engage with the shoulder within the slot of the drill string component.

9. The system of claim 7, wherein the slot is open to an internal volume of the bore.

10. The system of claim 7, wherein the electromagnetic transmission line comprises a protective tube enclosing internal wiring and the inner sleeve is crimped onto an outer diameter of the protective tube of the electromagnetic transmission line.

11. The system of claim 10, wherein the protective tube comprises a metal tube.

12. The system of claim 7, further comprising a spacer positioned between the inner sleeve and the outer sleeve.

13. The system of claim 12, wherein the spacer has an adjustable length.

14. The system of claim 13, wherein adjustment of the length of the spacer modifies a position of the outer sleeve along the electromagnetic transmission line.

15. The system of claim 7, wherein the electrical connector is configured to electrically couple a wireless transmission element to the electromagnetic transmission line, the wireless transmission element configured to wirelessly transmit signals.

16. An apparatus for retaining an electromagnetic transmission line within a drill string component, the apparatus comprising:

a drill string component comprising:

a bore having an internal surface, a slot in the internal surface of the bore, the slot being configured to receive an electromagnetic transmission line, and a shoulder in the slot; and a tension anchor configured to be engaged with the electromagnetic transmission line, the tension anchor comprising:

an inner sleeve configured to be crimped onto an outer diameter of the electromagnetic transmission line, an outer sleeve configured to be coupled with the inner sleeve, a spacer configured to be positioned between the inner sleeve and the outer sleeve in a coupled state of the outer sleeve with the inner sleeve, and an electrical connector configured to be electrically coupled with the electromagnetic transmission line, wherein the tension anchor is further configured to be received in the slot in engagement with the shoulder.

17. The apparatus of claim 16, wherein the spacer has an adjustable length.

18. The apparatus of claim 17, wherein, in a coupled state of the outer sleeve with the inner sleeve, adjustment of the length of the spacer modifies a position of the outer sleeve along the electromagnetic transmission line.

* * * * *